US011493254B2

(12) United States Patent
Rupp

(10) Patent No.: US 11,493,254 B2
(45) Date of Patent: Nov. 8, 2022

(54) BLOCK ICE SHAVER WITH TENSION ARM AND SHAPING DEVICE

(71) Applicant: Snowie LLC, Salt Lake City, UT (US)

(72) Inventor: Carl A. Rupp, Salt Lake City, UT (US)

(73) Assignee: Snowie LLC, Salt Lake City, UT (US)

( * ) Notice: Subject to any disclaimer, the term of this patent is extended or adjusted under 35 U.S.C. 154(b) by 797 days.

(21) Appl. No.: 16/459,447

(22) Filed: Jul. 1, 2019

(65) Prior Publication Data

US 2019/0390888 A1 Dec. 26, 2019

Related U.S. Application Data

(63) Continuation of application No. 14/668,835, filed on Mar. 25, 2015, now Pat. No. 10,378,807, which is a continuation-in-part of application No. 14/605,767, filed on Jan. 26, 2015, now Pat. No. 10,215,468, which is a continuation of application No. 13/414,170, filed on Mar. 7, 2012, now Pat. No. 8,939,389.

(60) Provisional application No. 61/970,349, filed on Mar. 25, 2014.

(51) Int. Cl.
*F25C 5/12* (2006.01)
*F25C 5/02* (2006.01)

(52) U.S. Cl.
CPC . *F25C 5/12* (2013.01); *F25C 5/02* (2013.01)

(58) Field of Classification Search
CPC .. F25C 5/02; F25C 5/043; F25C 5/046; F25C 5/12; B02C 18/083; B02C 18/143; B02C 18/302; B02C 18/365; A47J 43/046; Y10S 241/17; B27L 11/002; B27L 11/02; B27L 11/005
USPC ..... 241/DIG. 17
See application file for complete search history.

(56) References Cited

U.S. PATENT DOCUMENTS

| | | | | |
|---|---|---|---|---|
| 1,449,917 A | | 3/1923 | Shaw | |
| 1,992,783 A | * | 2/1935 | Smith | F25C 5/12 241/DIG. 17 |
| 2,191,756 A | | 2/1940 | Gray | |
| 2,646,223 A | * | 7/1953 | Quintilian | F25C 5/12 241/278.1 |
| 2,649,882 A | | 8/1953 | Chopieska | |
| 2,728,368 A | | 12/1955 | Guilder | |
| 3,679,140 A | | 7/1972 | Kaishita | |
| 4,199,112 A | | 4/1980 | McLean | |
| 4,394,984 A | * | 7/1983 | Hight | B02C 18/143 241/278.1 |
| 4,575,012 A | | 3/1986 | Uphoff et al. | |
| 4,588,136 A | | 5/1986 | Homma | |

(Continued)

FOREIGN PATENT DOCUMENTS

| | | |
|---|---|---|
| JP | 2007155272 A | 6/2007 |
| WO | 2015148720 A1 | 10/2015 |

*Primary Examiner* — Jessica Cahill
*Assistant Examiner* — Jared O Brown
(74) *Attorney, Agent, or Firm* — Terrence J. Edwards; TechLaw Ventures, PLLC

(57) ABSTRACT

The disclosure extends to devices, systems and methods for producing a shaved ice product using shaved ice confection machines and processes. The disclosure also extends to a tension arm and a shaping device used in conjunction with shaved ice confection machines and processes to produce more consistent shaved ice output with a potential increase in machine life.

20 Claims, 27 Drawing Sheets

(56) References Cited

U.S. PATENT DOCUMENTS

| | | | | |
|---|---|---|---|---|
| 4,655,403 | A | 4/1987 | Sciortino | |
| 4,718,610 | A | 1/1988 | Gallaher | |
| 5,007,591 | A | 4/1991 | Daniels, Jr. | |
| 5,050,809 | A | 9/1991 | Rupp | |
| 5,299,718 | A | 4/1994 | Shwery | |
| 5,402,949 | A | 4/1995 | Berner et al. | |
| 5,897,064 | A * | 4/1999 | Rupp | F25C 5/12 241/DIG. 17 |
| 6,257,511 | B1 * | 7/2001 | Turner | B02C 18/18 241/296 |
| 6,328,236 | B1 | 12/2001 | Upson | |
| 6,394,373 | B1 * | 5/2002 | Morris | F25C 5/12 241/DIG. 17 |
| 6,527,212 | B2 * | 3/2003 | Rupp | F25C 5/12 241/86.1 |
| 6,748,853 | B1 | 6/2004 | Brady | |
| 6,814,323 | B2 * | 11/2004 | Starr | A47J 43/046 241/292.1 |
| 6,817,749 | B2 | 11/2004 | Saunders | |
| 6,854,675 | B2 | 2/2005 | Wong | |
| 6,908,053 | B2 | 6/2005 | Rupp | |
| 7,134,620 | B1 | 11/2006 | Lee | |
| 7,261,537 | B2 | 8/2007 | Mitz | |
| 8,033,551 | B2 | 10/2011 | Tatomir | |
| 8,939,389 | B2 | 1/2015 | Rupp | |
| 10,215,468 | B2 | 2/2019 | Rupp | |
| 10,378,807 | B2 | 8/2019 | Rupp | |
| 2002/0053616 | A1 | 5/2002 | Rupp | |
| 2002/0079393 | A1 | 6/2002 | Karkos, Jr. et al. | |
| 2003/0031083 | A1 | 2/2003 | Saunders | |
| 2005/0170054 | A1 | 8/2005 | Czark | |
| 2005/0258286 | A1 | 11/2005 | Katz | |
| 2006/0043222 | A1 | 3/2006 | Lee | |
| 2006/0163396 | A1 | 7/2006 | Kennedy | |
| 2008/0061174 | A1 | 3/2008 | Comstock et al. | |
| 2009/0254231 | A1 | 10/2009 | Bartling | |
| 2010/0313593 | A1 | 12/2010 | Lee | |
| 2013/0233142 | A1 | 9/2013 | Rupp | |

* cited by examiner

BLOCK ICE SHAVER WITH TENSION ARM AND SHAPING DEVICE

CROSS-REFERENCE TO RELATED APPLICATIONS

This application is a continuation of U.S. patent application Ser. No. 14/668,835, filed on Mar. 25, 2015, entitled "BLOCK ICE SHAVER WITH TENSION ARM AND SHAPING DEVICE," which claims the benefit of U.S. Provisional Application No. 61/970,349, filed Mar. 25, 2014, and which is a continuation-in-part of U.S. application Ser. No. 14/605,767 filed on Jan. 26, 2015 (U.S. Pat. No. 10,215,468), entitled "BLOCK ICE SHAVER," which is a continuation of U.S. application Ser. No. 13/414,170, filed on Mar. 7, 2012 (U.S. Pat. No. 8,939,389) entitled "BLOCK ICE SHAVER," which are hereby incorporated by reference herein in their entireties, including but not limited to those portions that specifically appear hereinafter, the incorporation by reference being made with the following exception: In the event that any portion of the above-referenced applications are inconsistent with this application, this application supersedes said portion of said above-referenced applications.

STATEMENT REGARDING FEDERALLY SPONSORED RESEARCH OR DEVELOPMENT

Not Applicable.

BACKGROUND

This disclosure relates generally to machines for preparing shaved ice confectioneries, and more particularly, but not necessarily entirely, to a block ice shaver that is particularly adapted for producing a light, fluffy, finely textured shaved ice, or powdered snow-like flavored food products.

A variety of machines have been developed, described and are widely known for creating or processing cold deserts and confectioneries by processing ice into more appealing eatable forms, such as snow cones and shaved ice. Such devices produce either ice granules (snow cones) or light, fluffy, finely textured shaved ice for subsequent flavoring using syrups. For consistency, a block of ice can produce more appealing ice shavings than cubed ice, for example.

Despite the advantages of shaved ice machines that are available in the marketplace, improvements are still being sought. Machines in the marketplace may have limitations such as, cumbersome ice block change procedures, frozen and impacted blades, blades that do not produce light, fluffy, finely textured shaved ice, and may produce inconsistent shaved ice textures because the feeding of an ice block into a blade is inconsistent or because the machine cannot adapt to the changing consistency of the ice as the block of ice begins to warm and melt. Such machines that may use large blocks of ice tend to operate at a relatively slow rate, require significant maintenance, and are incompatible with either home use or large volume use.

Further, such machines may not be able to accommodate the changes in the texture of the block of ice as the ice begins to warm. As ice begins to warm and changes from a very cold state to a warmer state, the texture and consistency of the ice to be shaved by a machine begins to change. As the ice warms, the texture of the ice begins to degrade and the quality of the shaved ice decreases making it more difficult for the machine to shave the warm ice, or at least the ability to provide a high quality shaved ice product is decreased because of the interaction between the blade of the machine and the ice block.

Machines in the marketplace may thus be characterized by several disadvantages that may be addressed by the disclosure. The disclosure minimizes, and in some aspects eliminates, the above-mentioned issues, and other problems, by utilizing the methods and structural features described herein.

The features and advantages of the disclosure will be set forth in the description which follows, and in part will be apparent from the description, or may be learned by the practice of the disclosure without undue experimentation and are readily apparent to those of ordinary skill in the art upon review of the following drawings, detailed description, claims and abstract of this disclosure. The features and advantages of the disclosure may be realized and obtained by means of the instruments and combinations particularly pointed out in the appended claims.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

Figure 1:
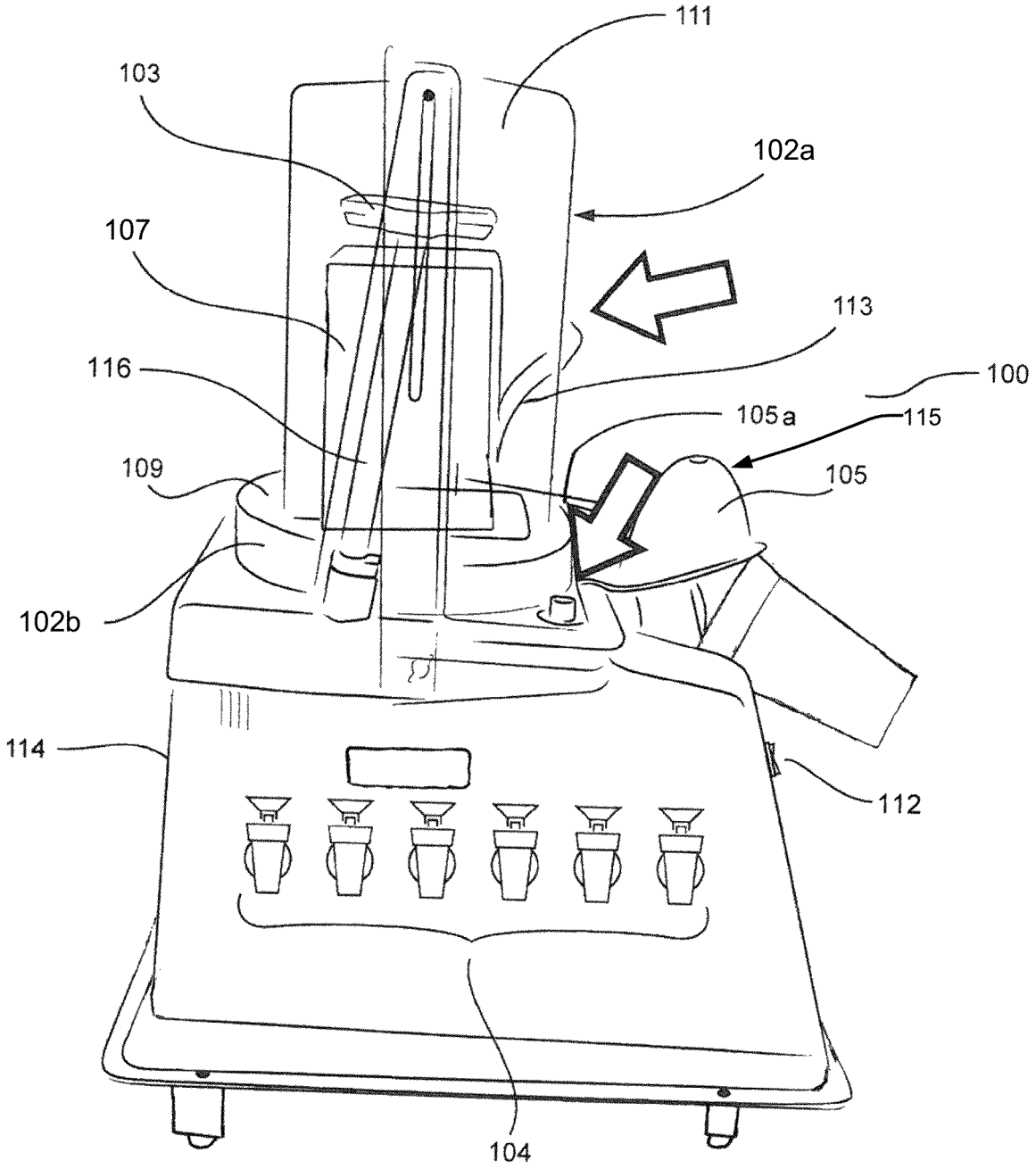
FIG. 1 illustrates a side, perspective view of an embodiment of an ice shaving machine made in accordance with the teachings and principles of the disclosure.

The disclosure extends to machines for preparing shaved ice or snow cone confectioneries. The disclosure also extends to an ice block guide or a tension arm used to provide a force on a block of ice to assist in maintaining the stability of the ice block while rotational forces acting upon the ice block as it is being shaved by a rotating blade. The disclosure also extends to a shaved ice or snow cone shaping device and an attachment mechanism for use with machines that prepare shaved ice or snow cone confectionaries or products.

Before the apparatus, system and methods for shaving ice, such as blocks of ice, are disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the disclosure will be limited only by the appended claims and equivalents thereof.

In the following description of the disclosure, reference is made to the accompanying drawings, which form a part hereof, and in which is shown by way of illustration specific implementations in which the disclosure may be practiced. It is understood that other implementations may be utilized and structural changes may be made without departing from the scope of the disclosure.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

As used herein, the term "motor" refers to a power source that imparts torque; or any rotating pneumatic or air motor, which does mechanical work by expanding compressed air; or any electromagnetic device used to convert electrical energy into mechanical energy; whether or not the power source, motor or electromagnetic device is housed within or as part of another device.

As used herein, the term "proximal" shall refer broadly to the concept of a nearest portion.

As used herein, the term "distal" shall generally refer to the opposite of proximal, and thus to the concept of a further portion, or a furthest portion, depending upon the context.

The disclosure relates to an ice shaving machine for receiving a block of ice and thinly slicing or shaving the block of ice to produce a powdery snow like textured confection. It should be noted that for the purposes of this disclosure an ice block is defined as a generally homogenous solid body or mass of ice having a volume that is greater than or equal to eight cubic inches, or that is larger than a typical household ice cube that may be placed inside of a user's cup to cool a drink. The ice block may be placed in a feeder of the ice shaving machine, which permits the block to come into contact with a blade of the ice shaving machine. The blade shaves off paper thin slices of ice to create a shaved ice product having a fine snow like texture. A collector collects the paper thin slices of ice and moves it to a spout of the ice shaving machine, under which a container is placed to receive the shaved, slices of ice. Once the container is sufficiently full, flavorings may be added, either through an integrated flavor dispensing system or from an individual flavor container or from a stand-alone flavor station having a plurality of containers and a plurality of dispensers for dispensing the flavorings. This disclosure comprises various embodiments and alternative blade designs, which are described in detail in the following detailed discussion.

Referring now to the figures, FIG. 1 illustrates a side, perspective view of an embodiment of an ice shaving machine 100 made in accordance with the teachings and principles of the disclosure. The machine 100 comprises a cabinet 114, which may be made of various materials, including stainless steel, a light weight fiberglass material, or a plastic material without departing from the scope or concept of the disclosure, for durability and ease of cleaning. It will be appreciated that various embodiments of the machine 100 may comprise one or more of the following features: a blade assembly 310, including a blade holder 301 and a blade 101; a safety cover 102*a* and a blade cover assembly 102*b*, including a spout assembly 105, a lid 111 and an ice block guide 113; an ice block feeder 103, including at least one drive shaft 116; a main drive motor 305 for rotating the blade assembly 310 (illustrated best in FIG. 3); and at least one motor 316 for actuating the at least one drive shaft 116 (illustrated best in FIG. 3). The machine 100 may also comprise a flavor dispenser 104.

Continuing to refer to FIG. 1, the safety cover 102*a* may be attached to the top of the cabinet 114 for receiving a block of ice 107 and covering the working parts of the machine 100, for example the blade assembly 310. The safety cover 102*a* may be manufactured from a generally clear "lexan" plastic material, although other sufficiently hard materials to protect a user and act as a safety cover may also suffice and are meant to fall within the scope of the disclosure. The safety cover 102*a* may have a base portion 109 for covering the blade assembly 310. The base portion 109 may be an outer shell fitting over and around the blade assembly 310, including the blade 101 and blade holder 301.

It will be appreciated that the spout assembly 115 may be a separate component from the cover 102*a*, and may be part of the blade cover assembly 102*b*. The spout assembly 115 may comprise a spout 105 that may be domed shaped or otherwise shaped for providing a domed round top or other shape of shaved ice for the produced shaved ice product. The spout assembly 115 may also comprise an outer shell or base portion 109 fitting over and around the blade 101 and the blade holder 301. The spout 105 and the outer shell or base portion 109 may be in mechanical communication with each other, such that shaved ice may move from the interior of the outer shell or base portion 109 through a conduit 105*a* to the spout or opening 105 for dispensing the shaved ice into a container (illustrated best in FIG. 1). It will be appreciated that the spout 105 may be shaped other than as a dome and may be part of, or separate from, the safety cover 102*a* and even the spout assembly 115. For example, the spout 105 may be in mechanical communication with the base portion 109 of the spout assembly 115, or the spout 105 may be attached directly to the cabinet 114 or other structural member, such that the spout 105 is not in mechanical communication with the spout assembly 115, but acts for creating a shaped shaved ice product, without departing from the scope of the disclosure.

Figure 2A:
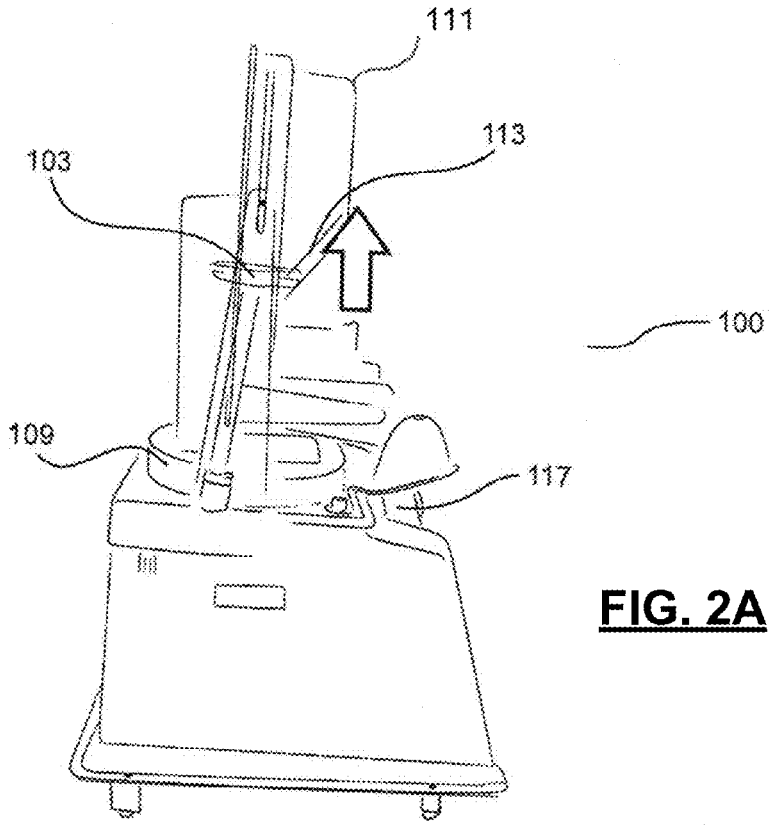
FIGS. 2A and 2B illustrate the loading of an ice block into an embodiment of an ice shaving machine made in accordance with the teachings and principles of the disclosure.
Figure 2B:
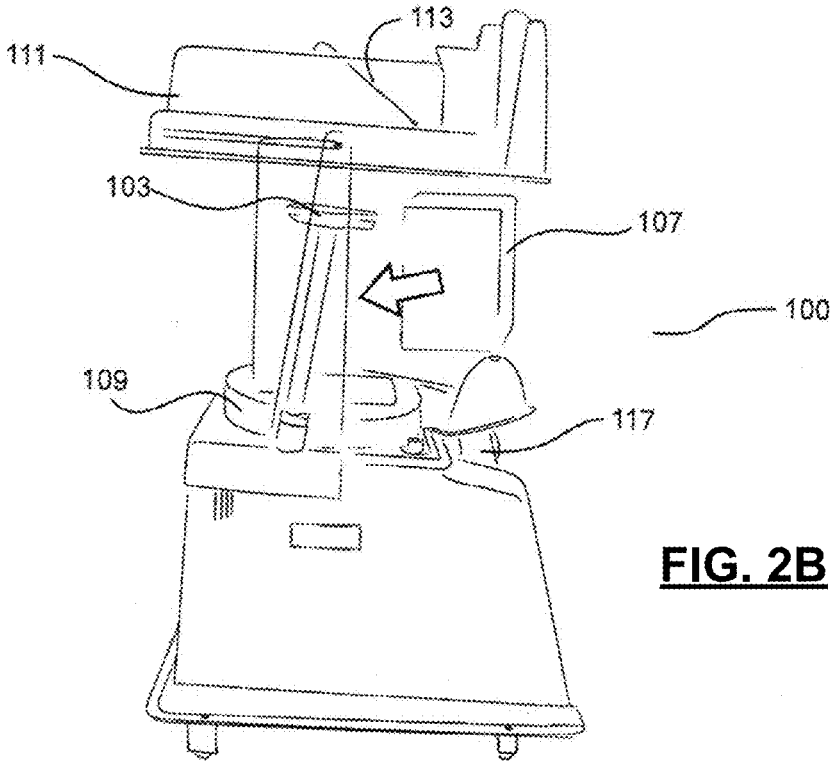

Referring now to FIGS. 2A and 2B, the spout assembly 115 may also comprise a flap 117 that may be a flexible material, such as a plastic or other material that is durable, but pliable, to help and assist a user in making a shaved ice confection. The flap 117 may be used as a part of the spout assembly 115 or may be a separate and distinct component. The flap 117 may be used as a guide to assist in the dispensing of the shaved ice, such that less shaved ice is lost as the shaved ice is dispensed from the spout 105 to the container. The flap 117 may at least partially wrap around the container and may be used, or operated, as a chute so that shaved ice is directed into the container as the shaved ice is dispensed from the spout 105 or other opening.

Mounted to the safety cover 102*a* is a lid 111 that may be movably fastened to the safety cover 102*a*. In an embodiment, an electrical or mechanical switch 112 is provided in the lid 111 safety cover 102*a* connection to shut off the operation of the machine 100 when the lid 111 is raised. The lid 111 may further comprise an ice block guide 113 that adds a biasing force laterally to the ice block so that the ice block will be more consistently fed into the blade 101. The ice block guide 113 may be a simple compliant type structure or may have a plurality of parts that produce a biasing force. The ice block guide 113, also referred to herein as a tensioning arm 113, may provide a force to assist in maintaining the stability of the ice block and resist rotational forces acting on the ice block as it is being shaved by a rotating blade 101.

Figure 3:
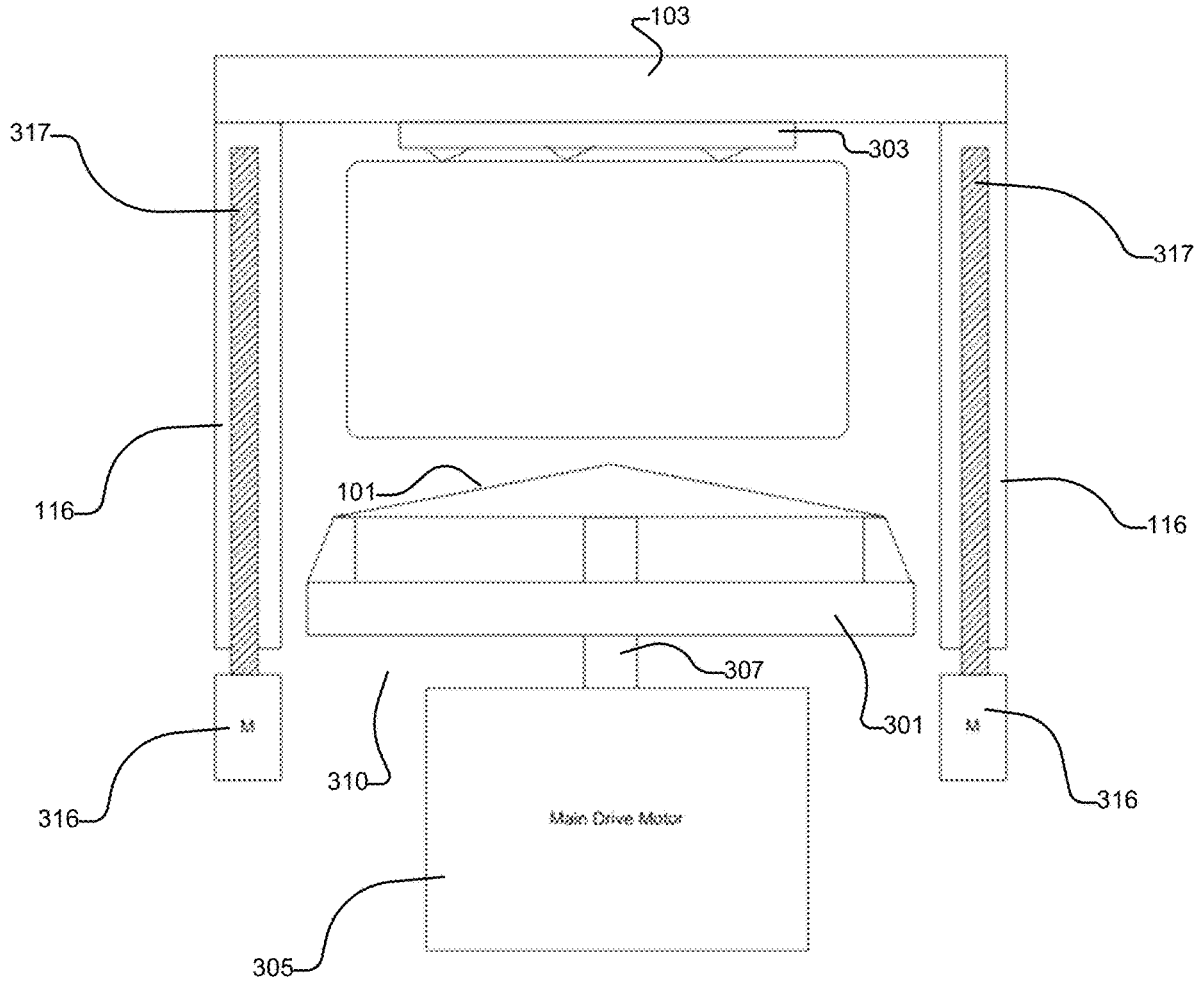
FIG. 3 illustrates a schematic view of several components of an embodiment of an ice shaving machine made in accordance with the teachings and principles of the disclosure.

Referring to FIGS. 2A-3, the ice block feeder 103 may comprise, or may be mounted or otherwise attached to, a drive shaft 116. The ice block feeder 103 may operate to contact the block of ice 107 and place a force on said block of ice 107. The drive shaft 116 operates to actuate the ice block feeder 103 into contact with the ice block 107, thereby bringing and forcing the ice block 107 into contact with the blade 101. The ice block feeder 103 may comprise or may be mounted or otherwise attached to a single drive shaft 116 or, alternatively, to two or more drive shafts 116. When two or more drive shafts 116 are utilized, the drive shafts 116 work in unison to force, move and push the ice block 107 into contact with the blade 101 to produce shavings of ice. The ice block feeder 103 may continuously move the ice block 107 into the blade 101, freeing flakes or shavings of ice, which are received by the spout 105 of the blade cover assembly 102*b*.

It will be appreciated that the blade 101 may be generally planer, generally circular, substantially flat and slotted with a plurality of slots or openings 151 (shown best in FIGS. 6, 13-16C). However, it will be appreciated that the blade 101 may be another geometric shape, besides circular, without departing from the scope of the disclosure. Each slot or opening 151 may have an adjacent edge 150 that may be slightly bent upwards toward the direction of the incoming ice block. This blade 101 may be made of high quality stainless steel material to maximize the blade life and reduce corrosion. Other non-corrosive high strength materials may also be used in place of stainless steel without departing from the scope of the disclosure. The blade 101 may be affixed to a blade holder 301 to form a blade assembly 310, such that the assembly can be rotated to provide more consistent ice shavings. While in use, the ice shavings fall through the blade 101 by way of the slots 151 and into a collection area where the shavings are moved toward the spout 105 and are then available to be dispensed as desired into a container. Once a sufficient quantity of ice shavings are collected in a container, flavoring may be added as desired.

Referring back to FIG. 1, a flavor dispenser 104 may be provided as part of the shaving device. In an embodiment of the disclosure 100, flavor selection switches may be provided on the front of the cabinet 114. The flavors may be provided by a plurality of inverted bottles or other containers (not shown), which may be fitted to receptacles on the top of the cabinet 114. An automated water switch may also be provided to flush or clean the flavoring from the dispenser system. The water can also be used to dilute the concentrated flavoring. A drain pan may be provided with a drain, which may have a drain hose for handling spills.

Referring back to FIGS. 2A and 2B, an embodiment of a block ice shaving machine 100 is illustrated as it is being loaded and used. During use, a user may slide the lid 111 in an upward direction to an open position. As can be seen in FIG. 2A, this movement is illustrated by the upward pointing arrow. In the open position, access to the ice block feeder 103 is provided and the ice block 107 can be loaded into position over the blade 101. It will be appreciated that the structural features of the safety cover 102*a* permit a user to gain access to the ice block 107, even after the ice block 107 has been loaded into the machine 100. The ability to access the block of ice 107 after being loaded into the machine 100 may be advantageous for several reasons, including the ability to clear blocked shaved ice from the blade 101 or the spout assembly 115 or removing unused portions of the block of ice and potentially others. Some machines that are available in the market do not allow or otherwise permit access to the ice once it is loaded into the machine. The result of those machines is that time and effort may be wasted while the machine either works to clear itself of frozen or otherwise stuck shaved ice, or simply shaves the excess ice that is loaded in the machine as waste product.

The ice block feeder 103 may be raised automatically or manually to allow the insertion of an ice block 107 into an opening or space between the ice block feeder 103 and the blade 101. An electronic switch may be provided to control the position and travel of the ice block feeder 103. The electronic switch, whether a toggle switch or a rocker switch, may control at least one electric motor 316 (illustrated best in FIG. 3) in order to raise and lower the ice block feeder 103. A voltage regulator/transformer may receive AC power via a standard three prong power cord and produces DC electric power for the motor 316. Between the voltage regulator/transformer and the motor 316 may be a speed controller, which includes a motor speed selection dial (not shown). The voltage regulator/transformer may be connected via an electric connection to the speed controller, which in turn, is connected to the motor 316. The motor may be a DC motor capable of turning the shaft at between 400 and 500 rpm. Alternatively, it is contemplated that an AC motor capable of 1100 rpm may be substituted. Other motor configurations can be substituted without departing from the spirit or scope of the disclosure. The motor 316 may be connected to one or more drive shafts 116 to drive the ice block 107 into the blade 101 at a predetermined rate and at a predetermined pressure or force.

One embodiment of the ice block feeder 103 is one that drives the ice block 107 at a range within about 180 lbs. to about 220 lbs. of pressure. In another embodiment, the ice block feeder 103 may apply more or less pressure than previously stated in the range, and may further use gravity and the mass of the ice block 107 itself to feed the ice block 107 into the blade 101.

As can be seen in FIG. 2B, the lid 111 may be rotated to lock into an open position for convenience. Other mechanisms may be employed to lock the lid 111 in an open position and are contemplated to be within the scope of the disclosure.

FIG. 3 illustrates a schematic view of an ice block shaved ice machine 100. In an embodiment, the block ice shaving machine 100 may comprise the main drive motor 305 that may be mechanically coupled or connected to the blade assembly 310, or directly to the blade 101, and configured for shaving ice from an ice block. The mechanical coupling may be accomplished through additional structures, such as gearing and pulleys or by blade holders 301. A control mechanism for activating and deactivating the mechanical drive mechanism, such as the main drive motor 305, may be used to operate the machine 100. For example, the control mechanism may comprise a switch device to control the main drive motor 305, which may be actuated by actuating the switch device. The switch device may be a toggle switch or a rocker switch, which may advantageously provide a safety mechanism such that there is substantially no chance of accidental bumping of the switch into an activated position. The main drive motor 305 may also be actuated using a foot pedal switch.

In an embodiment, the blade 101 may be attached to the blade holder 301, and it is the blade holder 301 that may be directly attached to the drive shaft 307 of the main drive motor 305. A blade holder 301 and blade 101 may be assembled together using complementary structures to form the blade assembly 310. It will be appreciated that the blade 101 may be attached or otherwise connected to the blade holder 301 using a variety of different mechanical structures. For example, threaded inserts and fasteners, screw fasteners, key and keyhole fasteners, post or prong style snap fasteners, mechanical pins, clips or hooks, anchors, bolts, clamps, locknuts, rivets, screws and washer assemblies, or other fasteners known or that may be become known in the future may be used to attach or connect the blade 101 to the blade holder 301 without departing from the scope of the disclosure.

Figure 12:
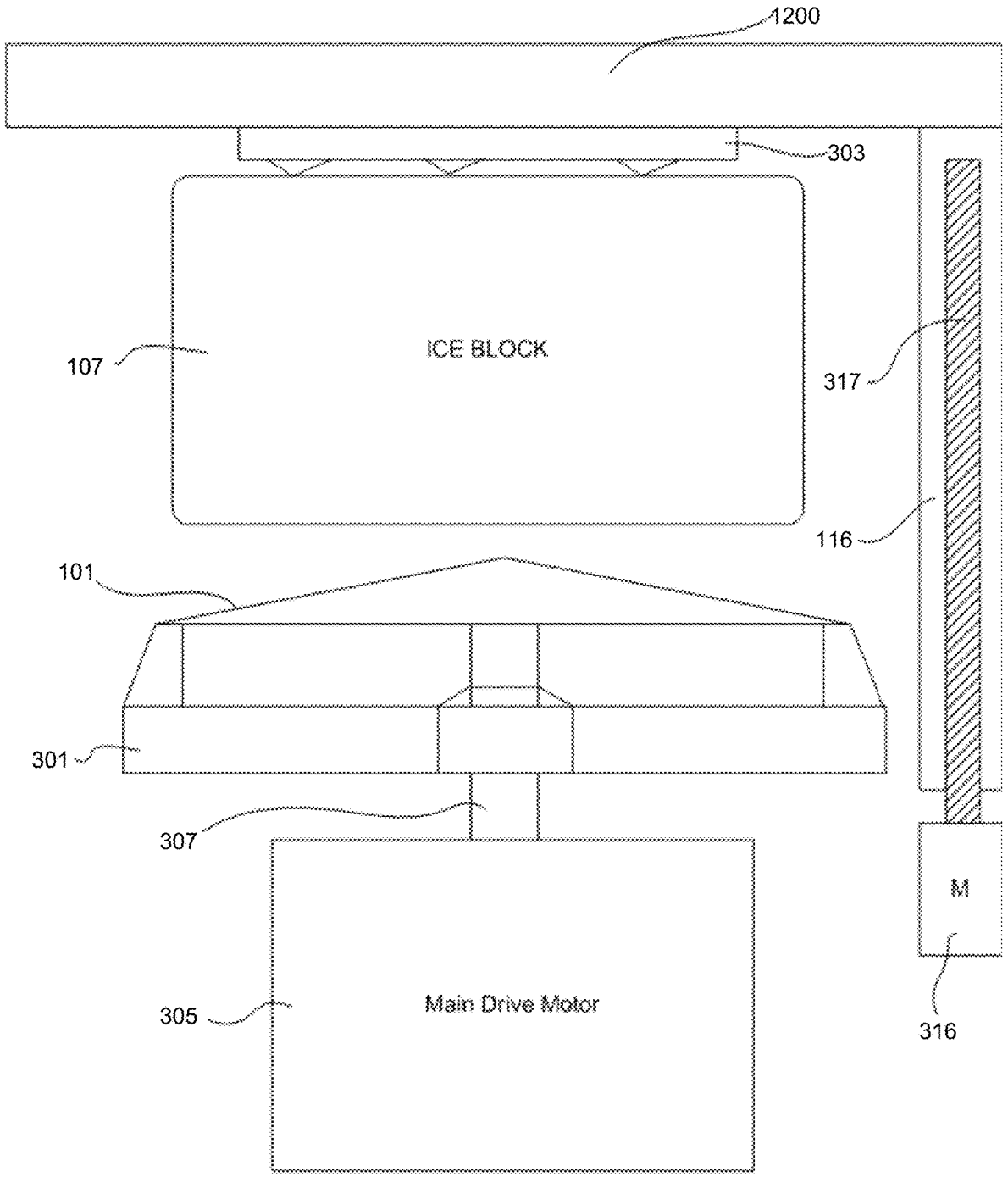
FIG. 12 illustrates a schematic view of an embodiment of an ice shaving machine having a single drive shaft for actuating the ice block feeder in accordance with the teachings and principles of the disclosure.
Figure 13:
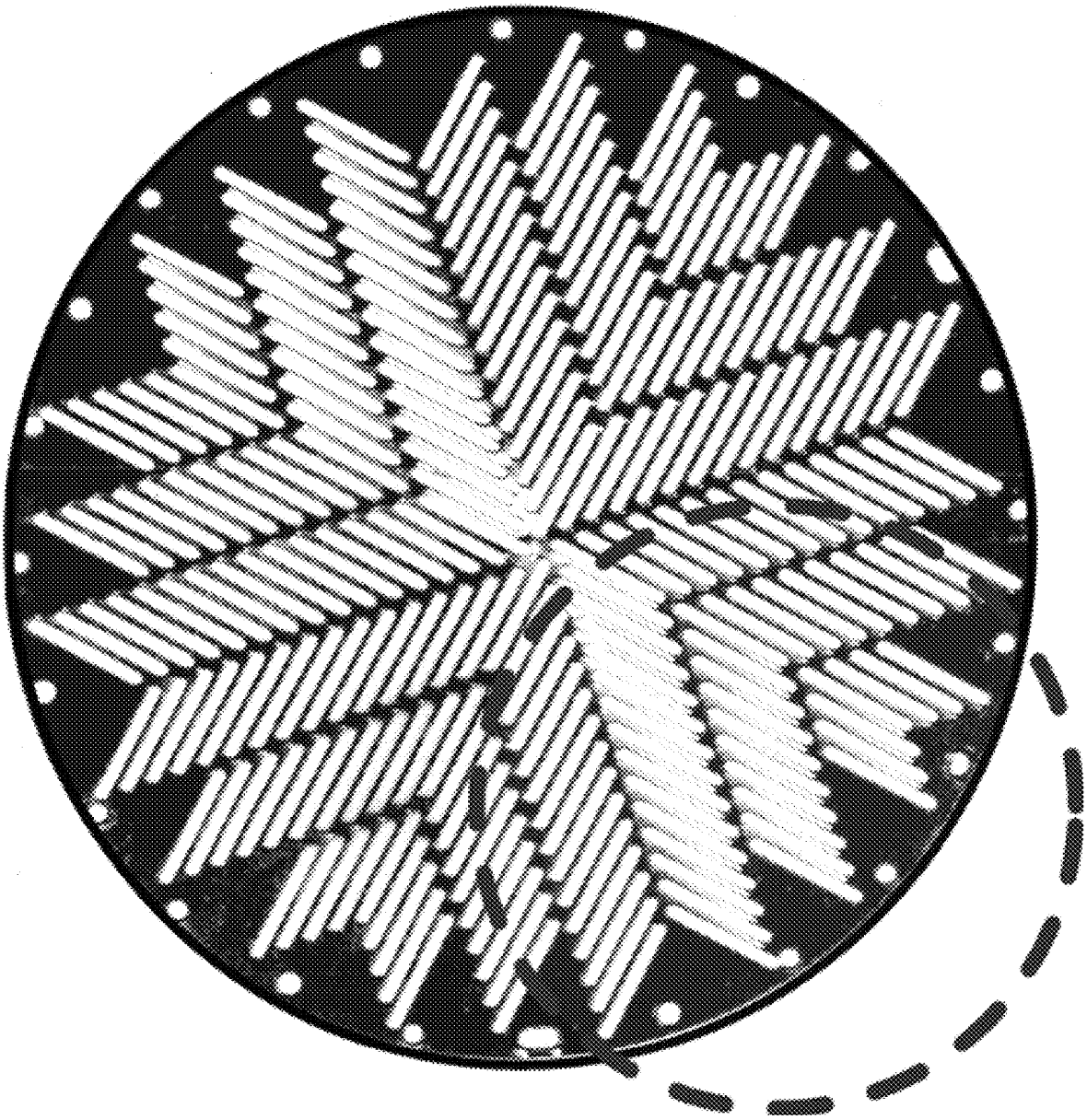
FIG. 13 illustrates an embodiment of a blade in accordance with the teachings and principles of the disclosure.

In an embodiment, the ice block feeder 103 of the shaved ice machine 100 may comprise, or may be connected to, one or more drive shafts 116. The drive shafts 116 may operate by way of a screw drive rod 317 that is driven by an ice block feeder electric motor 316. The drive shafts 116 may be connected one to another with a push plate 303 that actually makes contact with the block of ice 107. Electronic controls may be employed to control any block feeder electric motors 316 as well as the main drive motor 305. In an embodiment, the main drive motor 305 may be mechanically coupled to the blade assembly 310 through a transmission or gear box (not shown) having predetermined operational inputs and outputs. As can be seen in FIG. 12, it is within the scope of the disclosure to contemplate an ice block shaving machine 1200 having less than two drive shafts 116, and it will be appreciated that the disclosure also contemplates a machine that has more than two drive shafts 116. The ice block shaving machine 1200 may have a single drive shaft 116 and may have additional structures to allow the successful use of a single drive shaft 116, such as a single motor 316.

Figure 4:
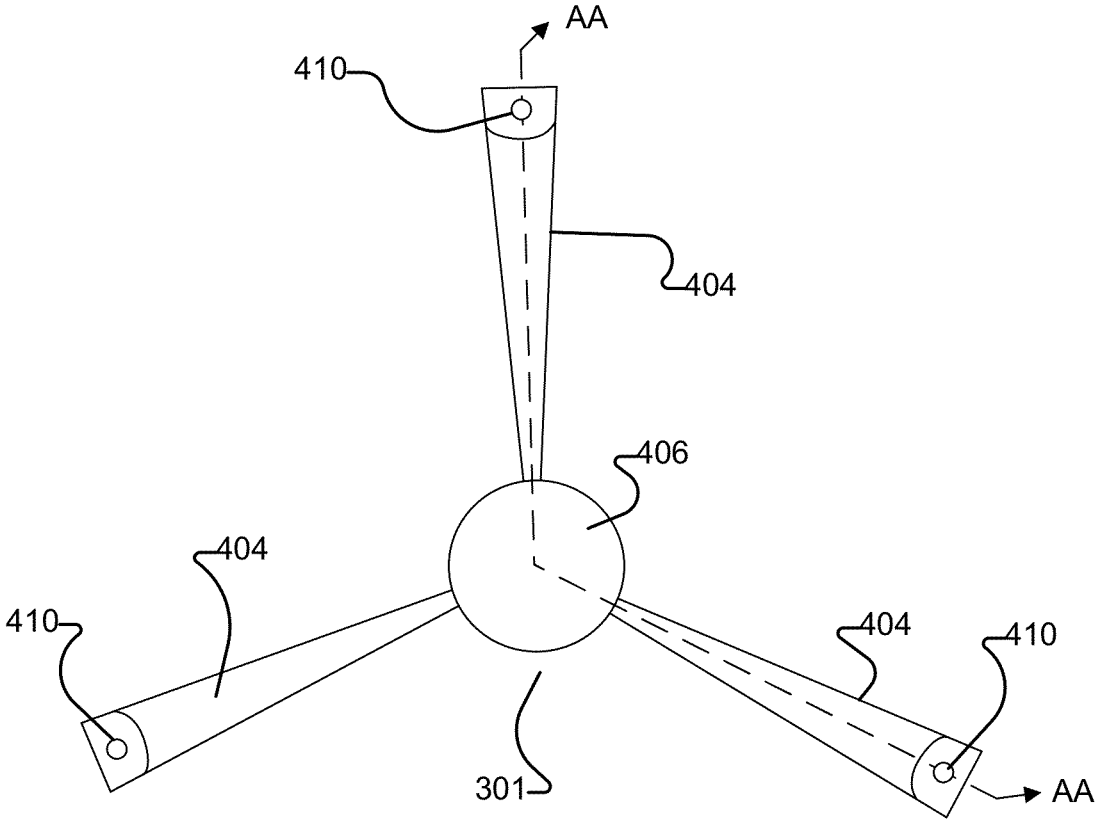
FIG. 4 illustrates an embodiment of a blade holder in accordance with the teachings and principles of the disclosure.

Referring now to FIG. 4, there is illustrated a top down view of the blade holder 301 of the blade assembly 310. In the embodiment shown, it can be seen that the blade holder 301 may comprise a plurality of arms 404. The drawings of this disclosure illustrate, for exemplary purposes only, embodiments having three or four arms, but it will be appreciated that the plurality of arms 404 may include two, three, four or more arms without departing from the scope of the disclosure.

In an embodiment, and as illustrated in FIG. 4, the blade holder 301 may comprise a plurality of arms 404, for example three arms 404. The plurality of arms 404 may each radiate out from a central hub 406. At some distance from the center hub 406, a fastening or attachment structure 410 may be disposed on each of the plurality of arms 404. The fastening or attachment structure 410 may correspond with an attachment point (such as 615 in FIG. 6 or 706 in FIG. 7)

of the blade 101. The fastening or attachment structure 410 may be used to fasten the blade 101 to the blade holder 301.

It will be appreciated that a radial measurement from a center of rotation of the blade holder 301, which center of rotation may be the center of the hub 406, to the attachment structure 410 of each of the plurality of arms 404 is less than a radial measurement from a center of rotation of the blade 101 to the attachment points (such as 615 of FIG. 6) of the blade 101. The result may be that the blade 101 is in a tensioned state as discussed more fully below with respect to FIGS. 8 and 9.

The center hub 406 may comprise a blade support that mechanically communicates and interacts with the blade to control the amount of flex of the blade as a load is placed on the blade. The result may be that the blade is loaded evenly thereby reducing wear and tear of the blade, which may extend the life of the blade.

In an embodiment, the blade 101 may be attached to the blade holder 301, and it is the blade holder 301 that is directly attached to the drive shaft 307 of the main drive motor 305. It should be noted that the blade holder 301 may be directly attached to a drive shaft of a motor with any manner of known means, such as complementary threaded portions, set screws or any other means known or yet to be discovered. With regard to the number of arms 404 of the blade holder 301, it may be advantageous to have enough arms 404 to control forces on the blade 101 and resist undesired rotation. For example, three arms 404, as illustrated in FIG. 4, would provide the desired stability in the typical "x" and "y" planes, such that the machine 100 will work relative to a single axis of rotation. It will be appreciated that the single axis of rotation may be a vertical axis or a horizontal axis of rotation. It will be appreciated that the single axis of rotation may be coaxial with a shaft, such as 307, of a drive motor, such as 305, in a simple embodiment. Alternatively, the single axis of rotation may not be coaxial or even parallel to a shaft, such as 307, of a drive motor, such as 305, if gearing is to be used in the machine.

Figure 5:
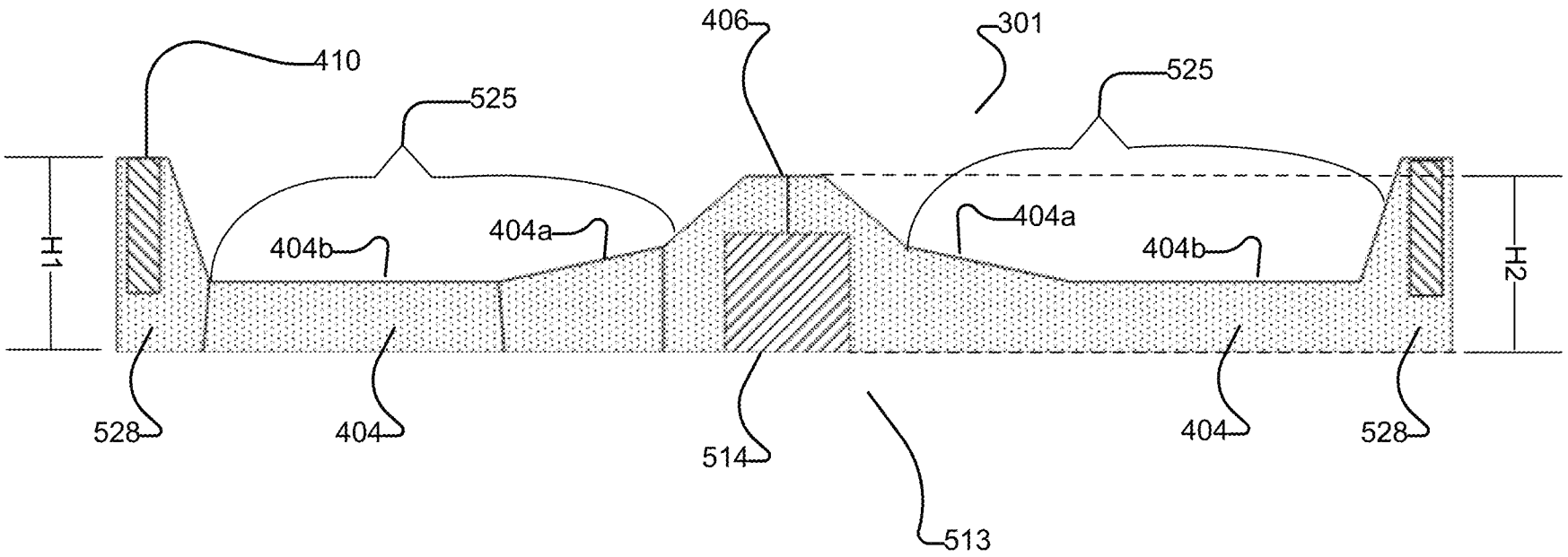
FIG. 5 illustrates a cut away view along section AA-AA in FIG. 4 of an embodiment of a blade holder in accordance with the teachings and principles of the disclosure.

Referring now to FIG. 5, the figure illustrates a cut-a-way view of a blade holder 301 defined by the cut lines AA-AA as shown in FIG. 4. In the cut-a-way view, greater detail regarding the center hub 406 is shown and which comprises a driver interface 513 having threads 514 that are schematically shown for this embodiment. A drive shaft (not shown) of an appropriate electric motor (not shown) may be inserted into the driver interface 513 and may be affixed by threading the threads 514 of the blade holder 301 onto corresponding threads on said drive shaft. The threads may be reverse threaded or traditionally threaded such that during use the blade holder 301 does not separate from the drive shaft. The blade holder may also be held with a set screw or key slot structure.

As can further be seen in FIG. 5, the plurality of arms 404 may comprise additional structures and structuring in order to provide desired functionality. For example, as illustrated, a pass-through portion 525 may be provided that allows ice shavings to pass over the top of the arm 404 yet under the blade 101, such that the ice shavings can freely move and be forced into a collection area and out of the spout 105. The pass through portion 525 may be defined by the attachment structure 410 on one end and the hub 406 on the other end as illustrated in FIG. 5. The pass through portion 525 allows the ice shavings to easily pass over the top of the arm 404 because of the height of the material forming the arm 404. As illustrated in the embodiment, the arm 404 may be formed by a sloping or tapered portion 404*a* adjacent the hub 406, which tapers in a proximal-to-distal direction with respect to the hub 406. The tapered portion 404*a* is immediately followed by a substantially planar portion 404*b*. It will be appreciated that there may be a pass-through portion 525 for each of the plurality of arms 404.

Accordingly, while ice is being shaved from a block of ice, the shavings will be allowed to fall through the slots or openings 151 in the blade 101 and into a collection area that is away from the blade 101 at all points under the blade 101. It will be appreciated that the greater the surface area present on the arm, such as 404 or 1104, the more potential there is for ice build-up on the arm. Thus, it is contemplated by the disclosure to have an arm 404 that may have a small surface area, thereby creating a larger pass through portion 525, or an arm 404 that may have a large surface area as illustrated in FIG. 5 thereby creating a smaller pass through area 525. In an embodiment, the arm may be relatively petite in comparison to the hub. The petiteness of the arm may allow any ice that has adhered to the material that comprises the arm to easily break off as the arm rotates, thereby continuing to permit ice shavings to pass over the arm and through the pass through portion 525.

A potential advantage of the pass through portion 525 is the ability for the ice shavings to move freely without substantial sticking, adhering, freezing to the arm of the blade holder or otherwise clogging up the machine. Allowing free movement of the ice shavings prevents clogging and freezing problems. The surface of the arms 404 may be textured or coated for decreasing icing problems. The arms 404 may further comprise a paddle portion 528 that, together with the arm structure, may help to control the movement of the ice shavings within the machine. The arms 404 may further comprise a fastening structure 410, which may include threaded openings, that may be configured to accommodate fasteners therein to attach the blade 101 to the blade holder 301 to form the assembly 310.

Figure 11:
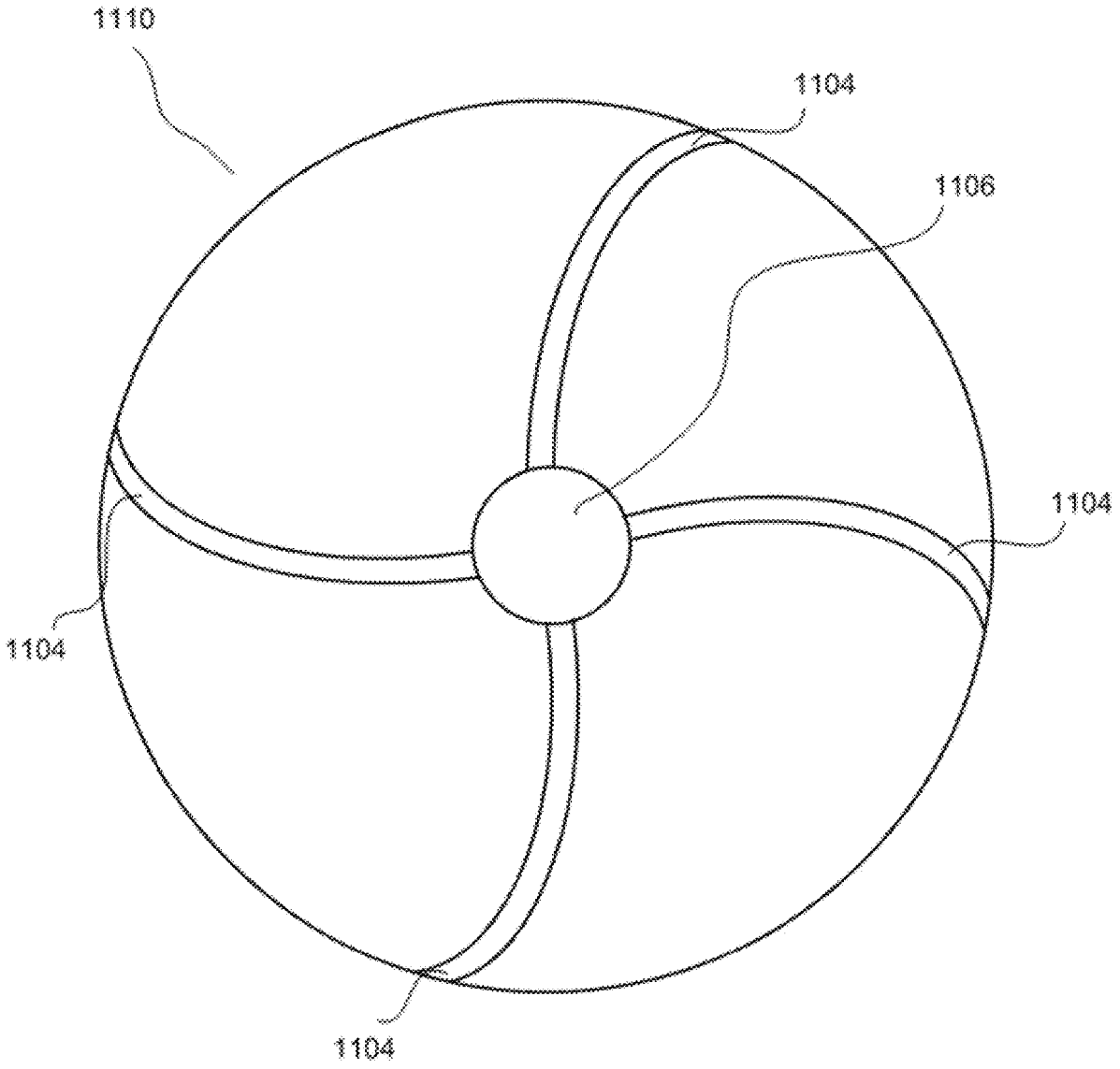
FIG. 11 illustrates an embodiment of a blade holder having enhanced features in accordance with the teachings and principles of the disclosure.

Additionally, as can be seen in FIG. 11, the arms 1104 of blade holder 1110 may be curved as they radiate out from the central hub 1106. The curvature of the arms 1104 may function and work to reduce the accumulation of ice shavings on the arm 1104. It will be appreciated that the radius of curvature of one or more of the plurality of arms 1104 may provide a for a greater or lesser reduction of the accumulation of ice shavings on that arm 1104.

Still further, it will be appreciated that the disclosure contemplates an embodiment wherein the arm may have a very large surface area, such that there is a very little pass through portion or substantially no pass through portion at all. In such an embodiment, substantially the entire arm operates and acts as a paddle to help move or push the shaved ice into the conduit 105*a* and out of the spout assembly 115 as the blade holder rotates.

Figure 6:
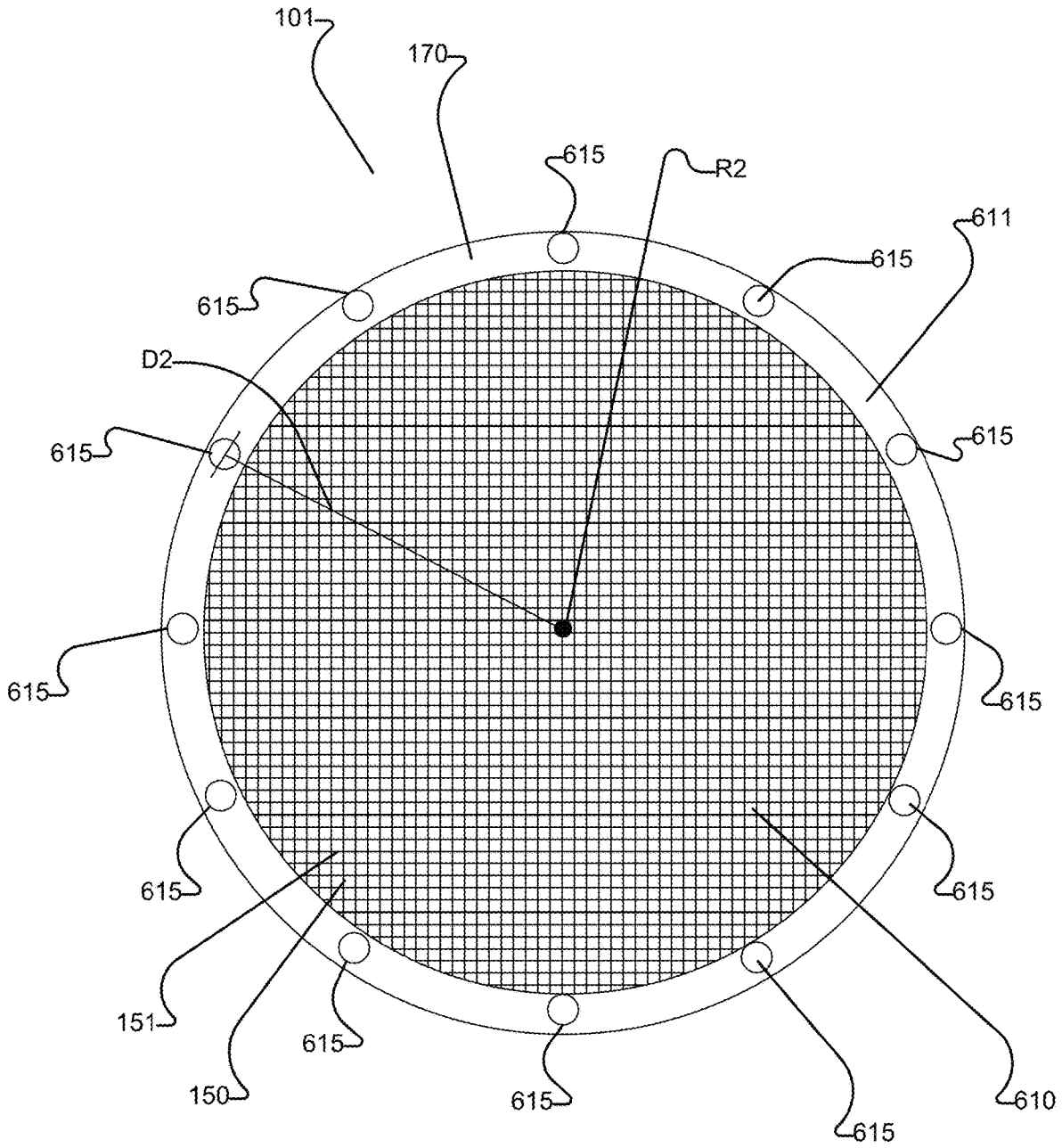
FIG. 6 illustrates a schematic, top view of an embodiment of a blade in accordance with the teachings and principles of the disclosure.

Referring now to FIG. 6, there is illustrated a schematic view of a blade 101 consistent with the teachings and principles of the disclosure. The blade 101 may be generally circular in shape and be configured to rotate about an axis that runs geometrically normal to a top surface 170 of the blade 101 and passes through the center point of the circular blade 101. However, it will be appreciated that the blade 101 may be another geometric shape, besides circular, without departing from the scope of the disclosure. The blade 101, may be generally planer, substantially flat and slotted with a plurality of slots or openings 151.

Figure 14:
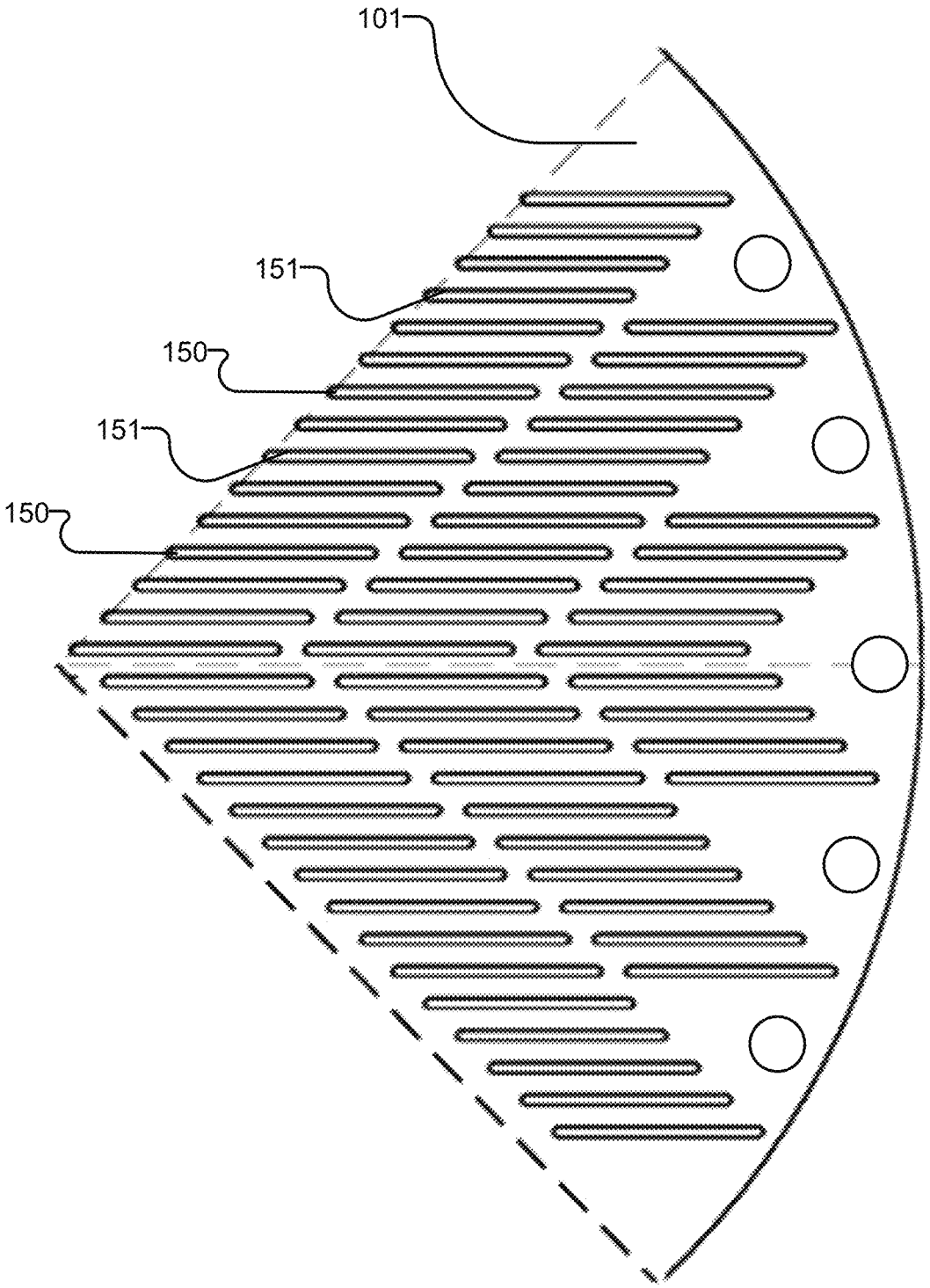
FIG. 14 is a detailed view of the embodiment of a blade illustrated in FIG. 13 illustrating the cutting surfaces and slots in accordance with the teachings and principles of the disclosure.
Figure 15A:
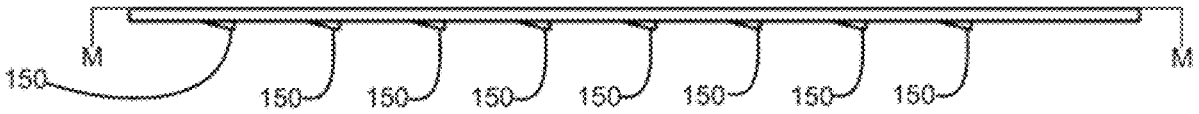
FIGS. 15A and 15B illustrate a side view and a side cross-sectional view taken along M-M of FIG. 15A of an embodiment of a blade in accordance with the teachings and principles of the disclosure.
Figure 15B:
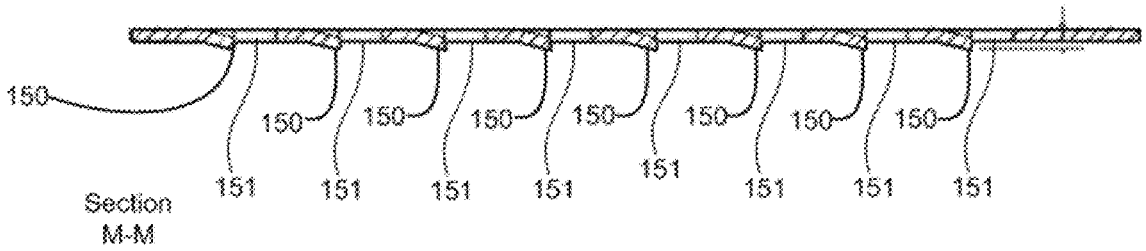

As illustrated in FIGS. 6, and 13-15B, there may be a significant number, perhaps hundreds, of slots or openings 151. Each slot or opening 151 may have an adjacent cutting edge 150 that may be slightly bent upwards toward the direction of the incoming ice block. In FIGS. 15A and 15B, which illustrate a side view and a side cross-sectional view of an embodiment of a blade in accordance with the teachings and principles of the disclosure, the cutting edge 150 is illustrated as pointing downward with respect to the page. However, it will be appreciated that the ice block may be forced into the cutting edge 150 or blade 101 as described herein. Thus, the blade 101 illustrated in FIGS. 15A and 15B may be oriented with respect to the ice block, such that the cutting edge 150 or blade 101 is positioned to cut into the ice block.

The blade 101 may be made of high quality stainless steel to maximize the blade life and reduce corrosion. Other non-corrosive high strength materials may also be used in place of stainless steel without departing from the scope of the disclosure. The blade 101 may be affixed to the blade holder 301 to form the blade assembly 310 such that the assembly can be rotated by a drive motor or other mechanical drive mechanism to provide more consistent ice shavings. For example, a hand crank or other mechanical drive mechanism may be used to rotate or drive the blade assembly without departing from the scope of the disclosure. While in use, whether through a drive motor or other mechanical drive mechanism, the ice shavings fall through the blade 101 by way of the slots 151 and into a collection area where the shavings are moved through a conduit toward the spout 105 and are then available to be dispensed as desired into a container. Once a sufficient quantity of ice shavings are collected in a container, flavoring may be added as desired.

The blade 101 may comprise a cutting portion 610, which may include the slots or openings 151 and the cutting edges 150, and a fastening portion 611. The fastening portion 611 may comprise radially placed attachment points 615. One or more of the attachment points 615 may be located around the perimeter of the blade 101. The attachment points 615 may be any structure that facilitates the attachment of the blade 101 to the blade holder 301 and may correspond with the fastening or attachment structure 410. In an embodiment, the attachment points 615 may be openings or holes that fasteners pass though and into the fastening structure 410 to secure the blade 101 to the blade holder 301. However, it will be appreciated that other fastening mechanisms may also be used without departing from the scope of the disclosure. For example, threaded inserts and fasteners, screw fasteners, key and keyhole fasteners, post or prong style snap fasteners, mechanical pins, clips or hooks, anchors, bolts, clamps, locknuts, rivets, screws and washer assemblies, or other fasteners known or that may be become known in the future may be used to attach or connect the blade 101 to the blade holder 301 without departing from the scope of the disclosure.

Figure 16A:
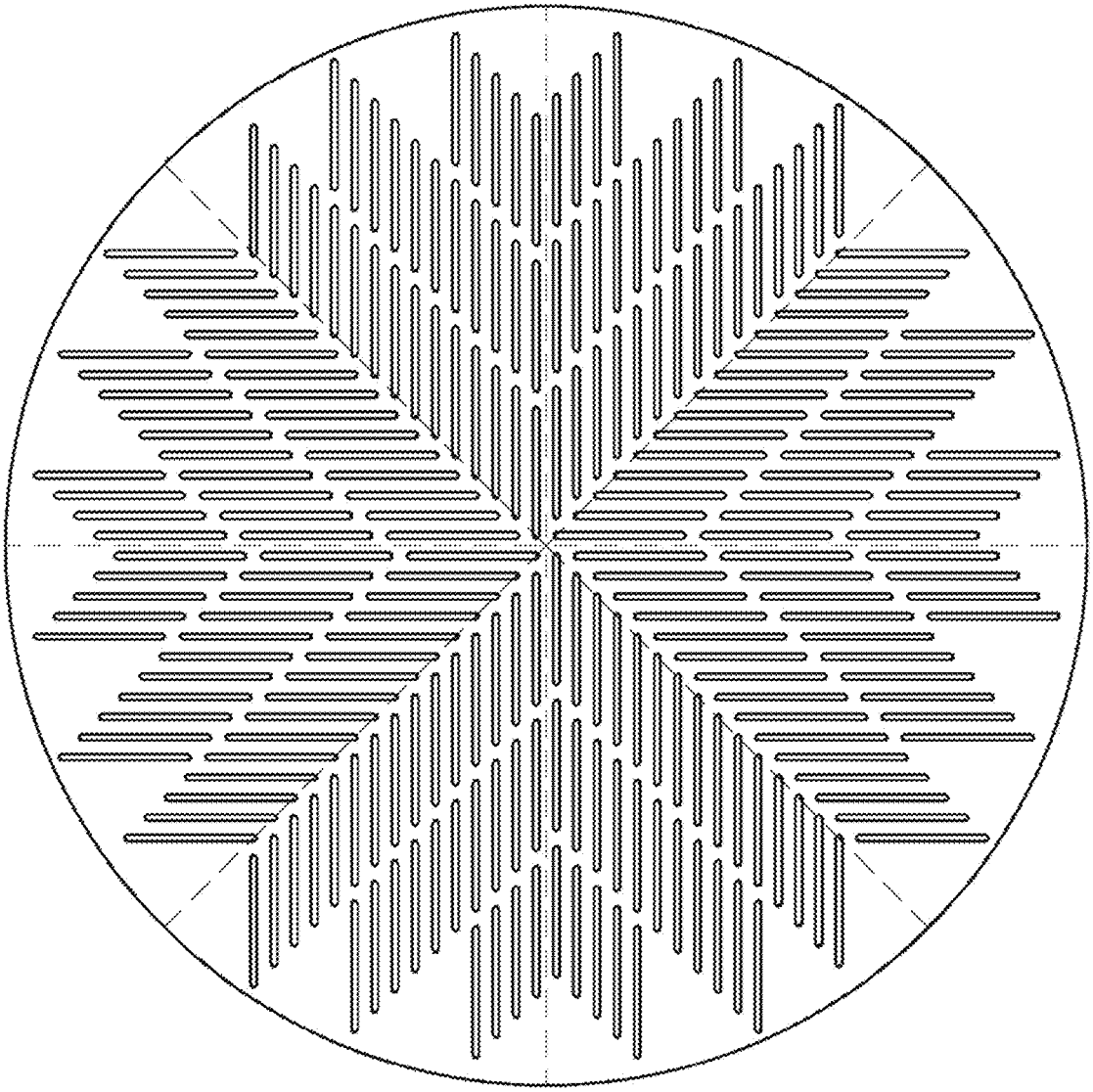
FIGS. 16A, 16B and 16C illustrate top views of various blade embodiments in accordance with the teachings and principles of the disclosure.
Figure 16B:
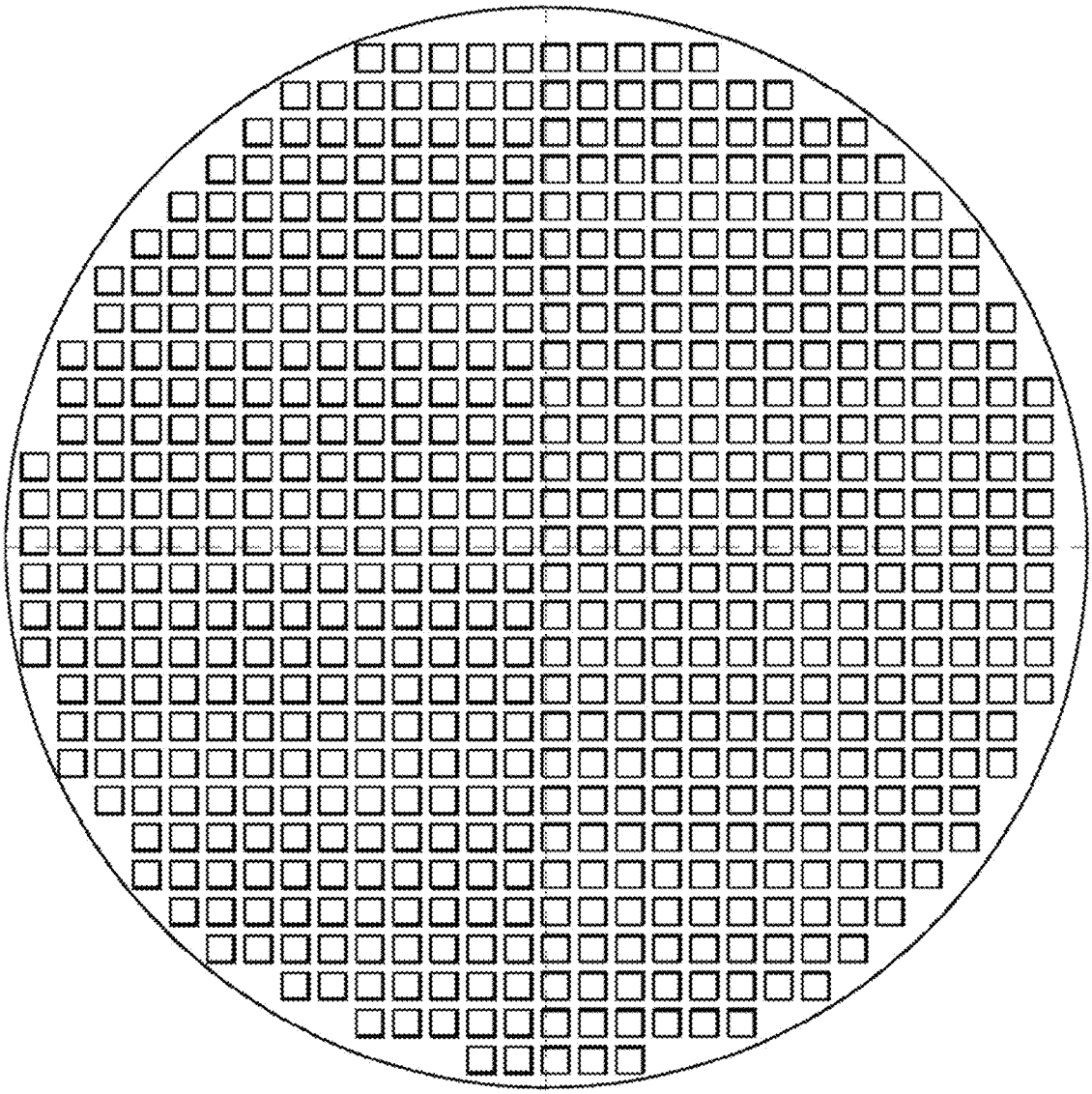
Figure 16C:
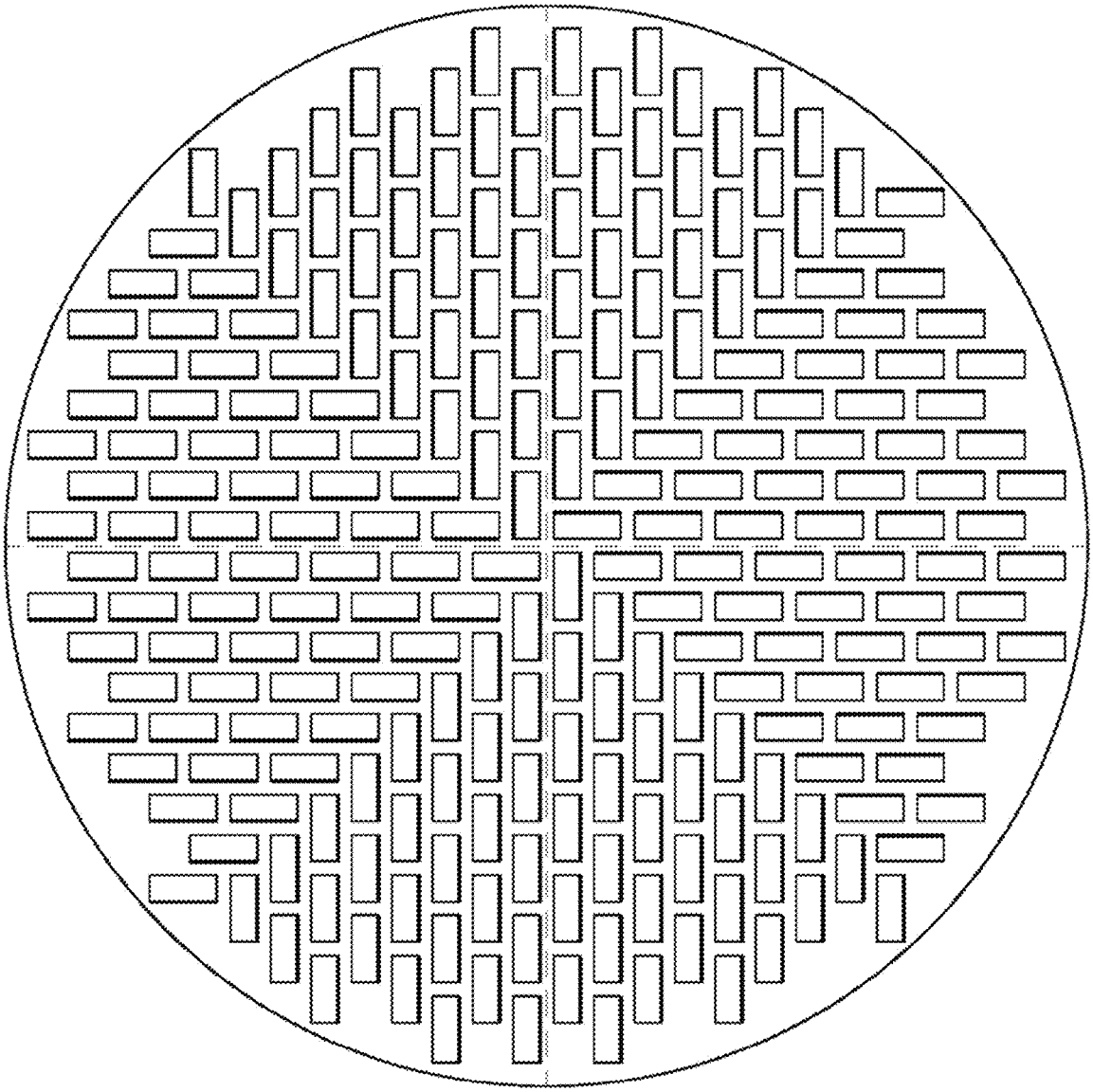

As can be seen in FIGS. 13-15B, an embodiment of the blade 101 can be seen that illustrates the adjacent placement of the raised cutting surfaces 150 relative to the slot or openings 151. FIG. 14 shows a detailed view of a portion of an embodiment of a blade 101 of FIG. 13. It should be noted that the ice shaving blade 101 may be made of many different and various configurations as far as the cutting surfaces 150 and slot 151 patterns are concerned. For example, FIGS. 16A, 16B, and 16C illustrate various embodiments of the blade 101 and examples of patterns created by the cutting surfaces 150 and slots or openings 151, which may be utilized by the disclosure.

It will be appreciated that a ratio of the surface area of the material from which the blade 101 is manufactured to the slot or opening area may be tailored or predetermined for desired shaved ice output and machine functionality. For example, the ratio may be about 25% material to about 75% opening, or the ratio may be inverted, such that there is about 75% material to about 25% opening. It will be appreciated that any ratio falling within the ranges given above are meant to fall within the scope of the disclosure, for example, the ratio may be 40% material to about 60% openings or about 60% material to about 40% openings.

An embodiment may have a blade 101 that corresponds to a blade holder 301 in which the blade 101 has more attachment points 615 than the blade holder 301 has arms 404. An embodiment may comprise a blade holder 301 having the same number of arms 404 as the blade 101 has attachment points 615. In certain embodiments, the blade 101 may be configured such that it flexes during use. Accordingly, in such embodiments the portions of the blade 101 that are adjacent to the arms 404 of the blade holder 301 may be more rigid than portions of the blade 101 that are further away from the support arms 404 of the blade holder 301. Consequently, the latter, less supported portions of the blade 101 may flex away from the block of ice during use and thus experience less wear and tear. Accordingly, it may be advantageous to rotate the blade 101 relative to the blade holder 301 (and affix the blade 101 to the blade holder 301 in an alternate position) thereby distributing the wear and tear across the whole blade surface, thereby more evenly wearing the cutting surfaces 150 of the blade 101 resulting in longer blade life.

Figure 7:
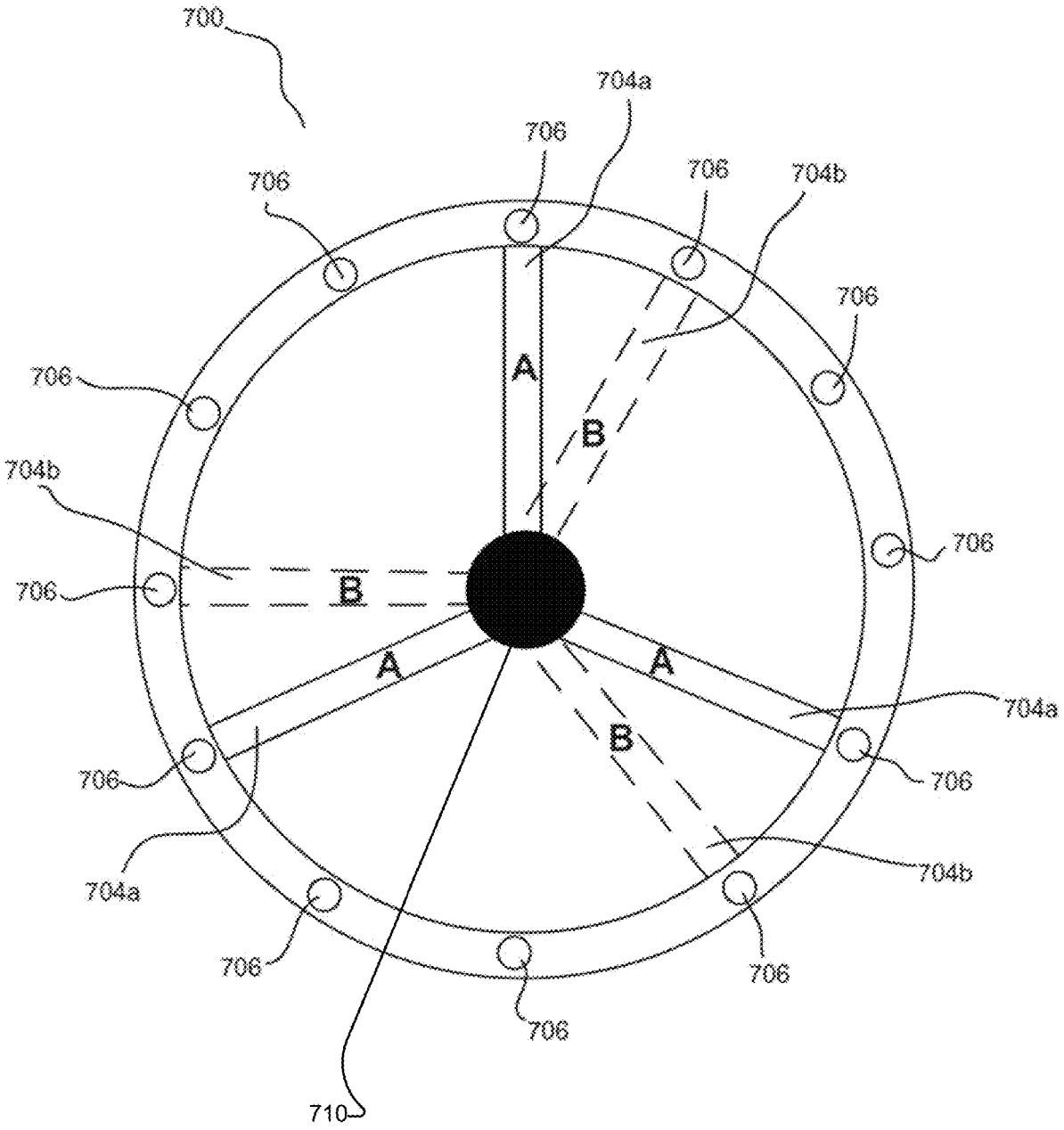
FIG. 7 illustrates an embodiment of a method and associated structures that allow the rotation of a blade relative to a blade holder in accordance with the teachings and principles of the disclosure.

Referring now to FIG. 7, there is illustrated a method and associated structures that allow the rotation of a blade relative to a blade holder. The blade 701 may be shifted or rotated with respect to the blade holder 710 in order to prolong the life of the blade 701. As can be seen in the figure, the blade holder 710 may comprise a plurality of arms 704, for example, three arms 704, and is shown being shifted or rotated in dashed lines relative to the blade 701 in order to prolong the usable life of the blade cutting surfaces. More specifically, the arms 704*a* may be positioned in position "A" in the figure, which position represents a first assembled position of the blade assembly 700. The arms 704*b* may be positioned in position "B" in the figure, which represents a second assembled position of the blade assembly 700. As a user determines that the blade 701 is performing in an unsatisfactory manner, the blade 701 can be rotated relative to the blade holder 710 to improve function. The blade 701 may be rotated incrementally one attachment point 706 at a time or may be rotated by a plurality of attachment points 706 in order to utilize a different part of the blade cutting surfaces that have not been used as much as other portions of the blade to extend the life and usefulness of the blade as long as possible.

Figure 8:
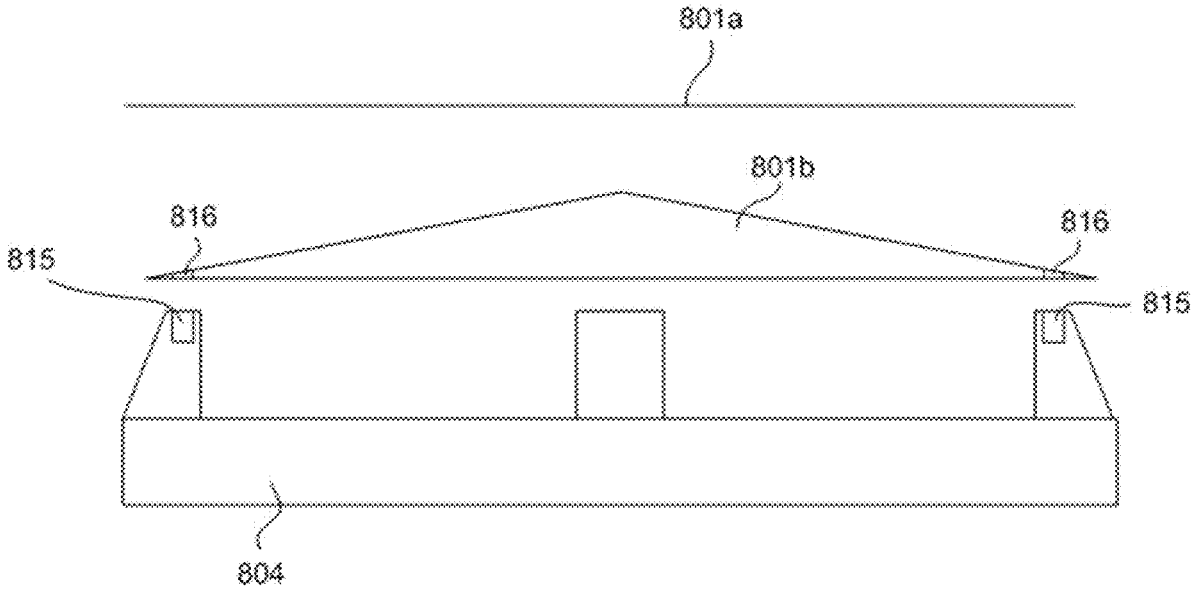
FIG. 8 illustrates the concept of tensioning of an embodiment of an ice shaving blade within a blade assembly in accordance with the teachings and principles of the disclosure.
Figure 9:
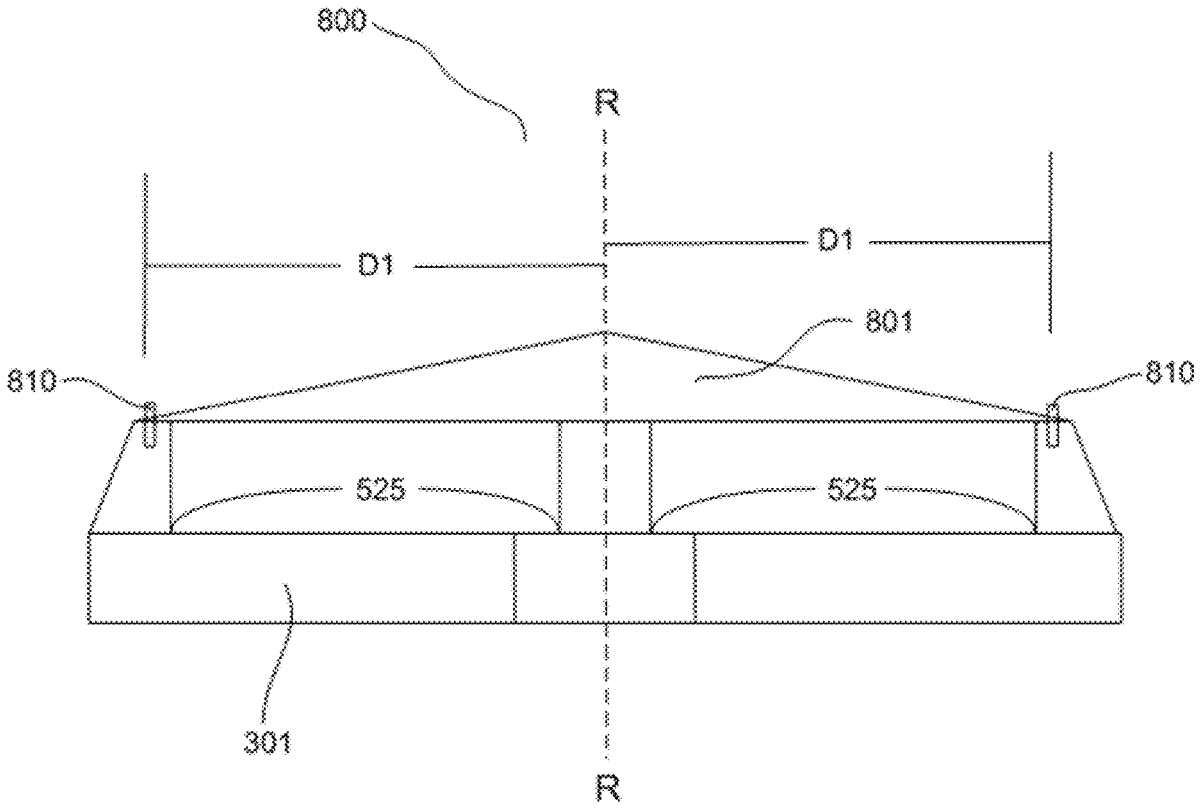
FIG. 9 illustrates an embodiment of a tensioned blade attached to a blade holder and forming a blade assembly in accordance with the teachings and principles of the disclosure.

FIGS. 8 and 9 illustrate the feature of a tensioned blade 801 in a blade assembly 800. In order to reduce the accumulation of unwanted ice, or ice build-up, on the blade 801, the blade 801 may be tensioned during the assembly of the blade assembly 800. As can be seen schematically in FIG. 8, the blade 801*a* may be relatively planer prior to assembly while it is in an un-tensioned state. The blade holder 810 may be configured with a distance between the mounting holes 815 on the blade holder arms 804 that is less than the distance between corresponding attachment points 816 of the blade 801.

It will be appreciated that a radial measurement or distance D1 (illustrated in FIG. 9 and FIG. 11*a*) from a center of rotation of the blade holder 301 (depicted as dashed line R-R in FIG. 9), which center of rotation R-R may be the center of the hub 406 (see FIG. 9), to the center of the attachment structure 410 of each of the plurality of arms 404 is less than a radial measurement or distance D2 (illustrated in FIG. 6) from a center of rotation R2 of the blade 101 to the attachment points (such as 615 of FIG. 6) of the blade 101. The radial measurement D1 may be between a range of about two inches to about eight inches, or may be between about three inches to about seven inches, or may be between about four inches to about six inches, or may be about five inches. It will also be appreciated that distances or lengths of the radial measurements D1 may be modified depending upon the size of the blade 101 and blade cover assembly 102*b* to be used with the machine 100. It will be appreciated that the distance or length of a diameter D3 of the blade holder 1110 may be approximately twice the length or distance of the radial measurement D1, such that the diameter may be between about four inches to about sixteen inches, or may be between about six inches to about fourteen inches, or may be between about eight inches to about twelve inches, or may be about ten inches. Due to the above mechanical properties and physical relationships, and as shown by the blade 801*b* in FIG. 8, the blade 801 will be placed in tension as and when it is attached to the blade holder 810. As illustrated in FIG. 9, the blade 801 is in a tensioned state when it is attached to the blade holder 810.

Referring briefly now to FIGS. 5 and 11, the fastening or attachment structure 528 of the blade holder 301 may extend upwardly from the arm 404. It will be appreciated that an angle may be formed between the arm 404 and the attachment structure 528 at an angle that is substantially normal to the plane in which the arm 404 generally lies, such that the attachment structure 528 may be aligned with the attachment points, such as 706, of the blade, such as 701, so that a fastener or other mechanical closure may secure the blade to the blade holder 301 to thereby form the blade assembly 310. The attachment structure 528 may comprise a height H1. The height H1 may be about 0.500 inch to about 3.0 inches, or may be about 1.0 inch to about 2.0 inches, or may be about 1.50 inches.

It will be appreciated that the hub 406 may also comprise a height H2, which may have a value that is less than, equal to, or larger than the height H1 of the attachment structure 1110. Thus, for example, the height H2 may be about 0.500 inch to about 3.0 inches, or may be about 1.0 inch to about 2.0 inches, or may be about 1.50 inches, when the height H2 of the hub 406 is about equal to the height H1 of the attachment structure 528. The height H2 of the hub 406 may also be about 0.650 inches to about 3.150 inches, or may be about 1.150 inches to about 2.150 inches, or may be about 1.650 inches, when the height H2 is larger than the height H1. A ratio of the height H2 of the hub 1106 to the height H1 of the attachment structure 1110 may be about 0.8 to about 1.5, or about 1.0 to about 1.5 or may be about 1.1 to about 1.3. The difference in height values, or lack thereof, between H1 and H2 may result in a blade that can flex to a predetermined extent until contacting the hub 1106. For example, when the height H1 is substantially equal to the height H2, the blade may be able to flex to a greater degree than when H2 is larger than H1.

Figure 10:
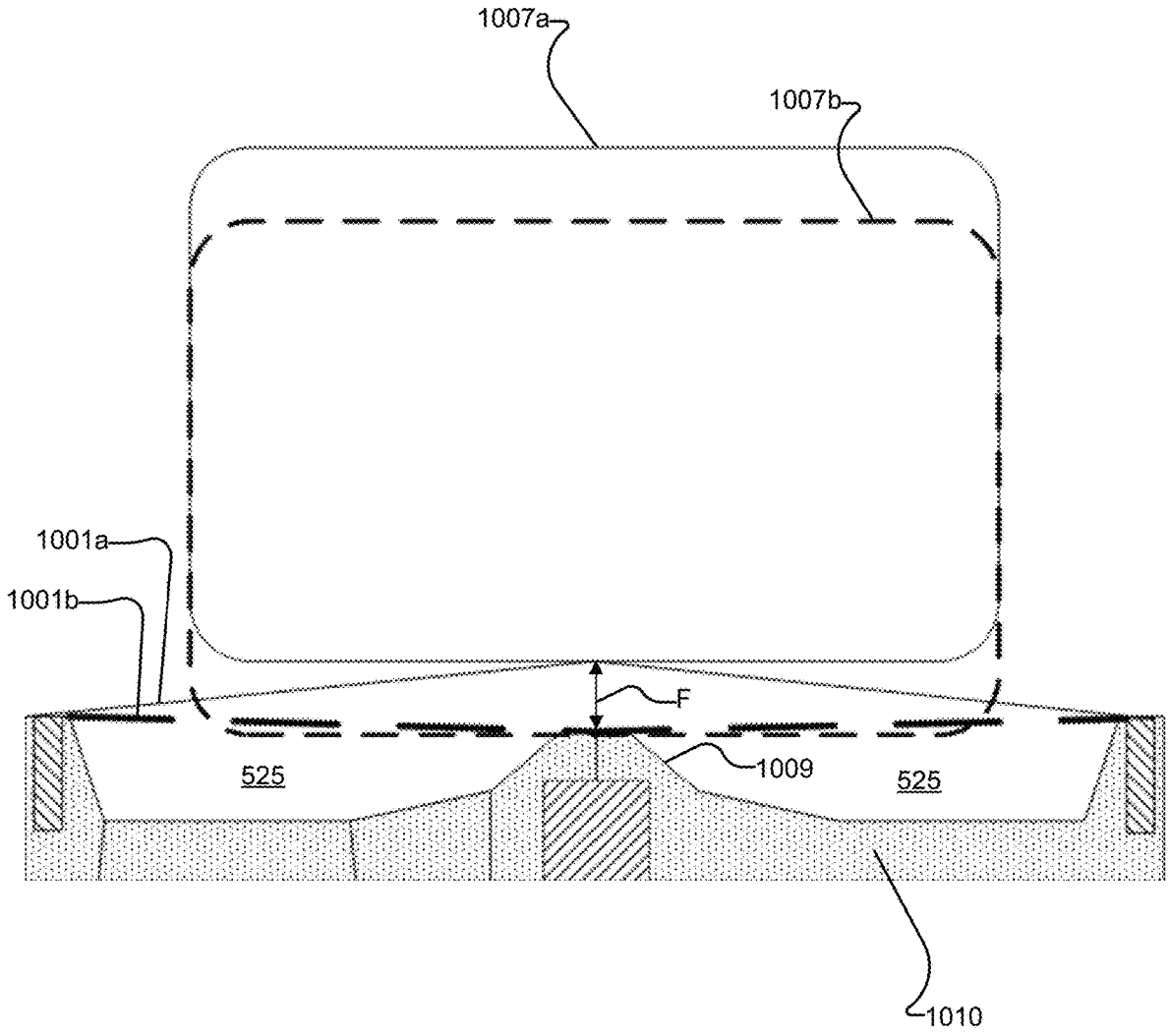
FIG. 10 illustrates the feature of a flexible blade in accordance with the teachings and principles of the disclosure.

Referring now to FIG. 10, the figure illustrates the feature of a flexible blade during use. In the figure it can be seen that as a block of ice 1007 is pushed into the spinning or rotating blade 1001, the blade flexes a distance represented in the figure as distance "F." In the figure, the ice block positioned and labeled at 1007*a* (and drawn in a solid line) represents an unloaded condition and position. As a load is applied to the ice block 1007*a* by an ice feeder 103 (illustrated best in FIGS. 1-3), the blade 1001*a* flexes to the blade positioned and labeled at 1001*b* (and drawn in dashed lines), which shows a loaded and flexed condition. The loads applied by the ice feeder 103 may range from the weight of the ice block itself to a considerable load of about 180 to about 220 lbs. of pressure or more (for example, 250 lbs. of pressure). Variables that can help determine the load to be applied may be such things as: the blade design, the blade material, the shaved ice rate, the limitation of ice feeder power, environmental conditions, the rotation rate of the blade and other factors.

The hub may comprise a support structure 1009 that mechanically communicates and interacts with the blade to control the amount of flex of the blade as a load is placed on the blade, such that the blade may be loaded evenly. The flex of the blade may be limited by the blade support structure 1009, which may be part of the hub or other structure, on the blade holder 1010 to prevent damage to the blade 1001. It will be appreciated that the support structure 1009 may comprise a substantially flat surface or may comprise a curved surface without departing from the scope of the disclosure. It will also be understood that the release of the load on the blade 1001 may allow the blade to move back into its original, unloaded position. When the load is released, the blade moves and experiences a "spring action," such that any built-up ice may be removed from the cutting surfaces of the blade 1001 as the blade springs back into its original, unloaded position.

It will be appreciated that the disclosure contemplates an embodiment in which the blade may be attached to the blade holder without being in tension, such that the blade does not flex. In such an embodiment, the blade may be substantially static with respect to the blade holder and hub.

Figure 17:
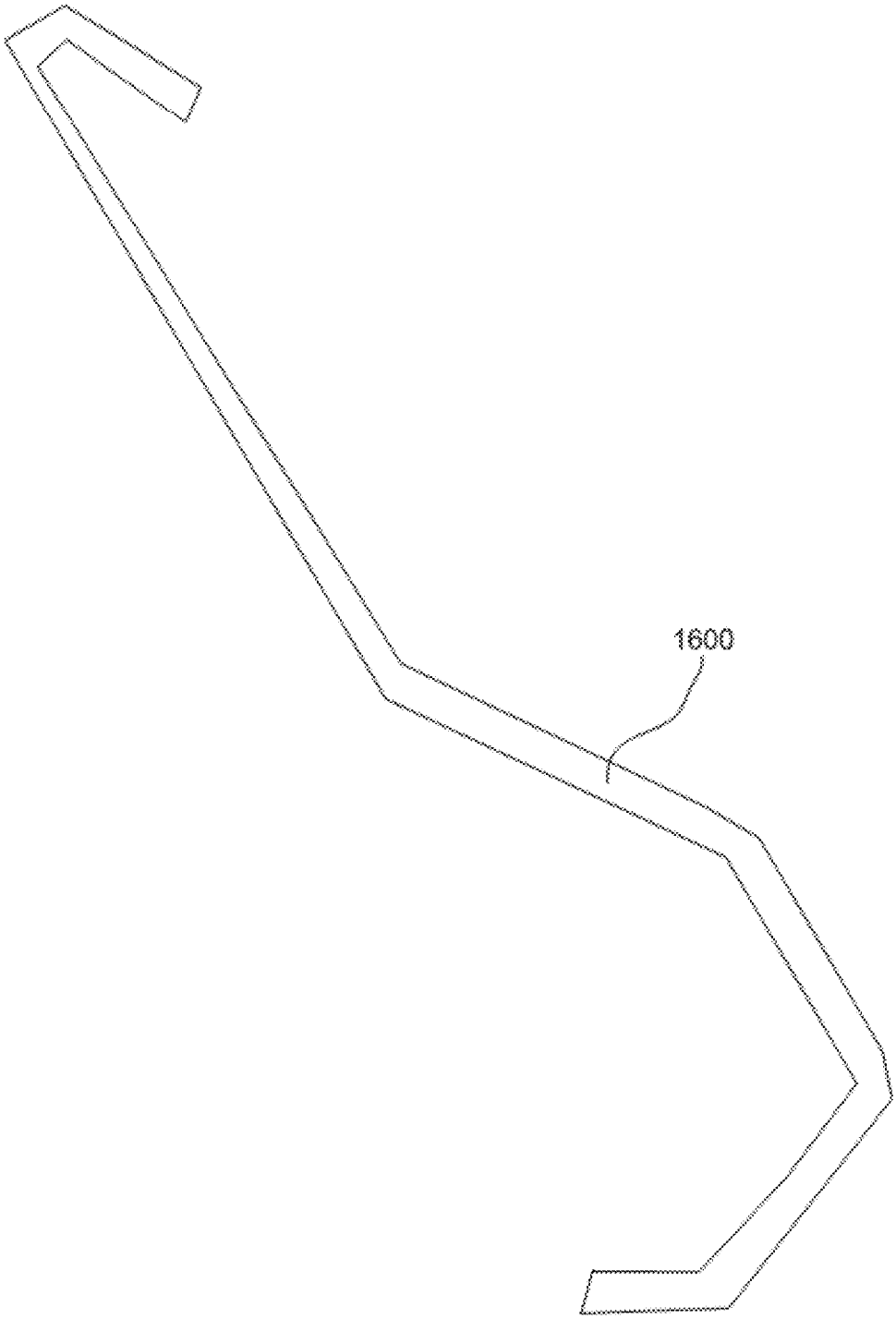
FIG. 17 illustrates an embodiment of a safety clearing tool for use with an ice shaving system disclosed herein and in accordance with the teachings and principles of the disclosure.

Referring now to FIG. 17, there is illustrated a tool for safely clearing blockages within an ice block shaving machine. A clearing tool 1600 may be included in a system comprising an ice shaving machine having a blade assembly.

Figure 18:
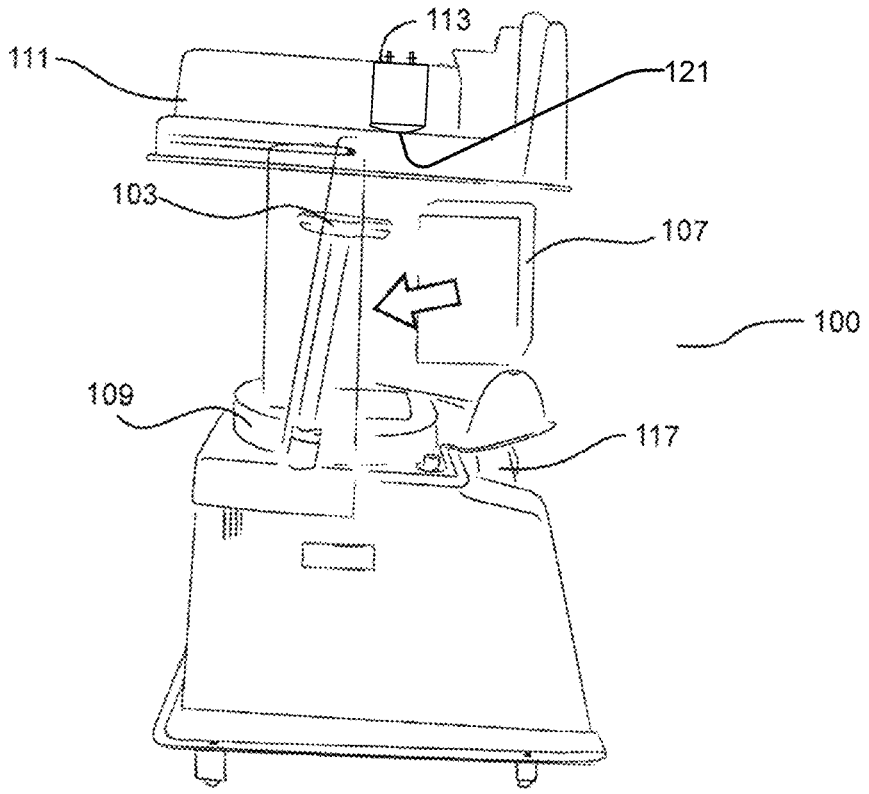
FIG. 18 illustrates a side view of an embodiment of an ice shaving machine having a housing partially lifted up with an ice block guide or a tension arm thereon and made in accordance with the teachings and principles of the disclosure.
Figure 19:
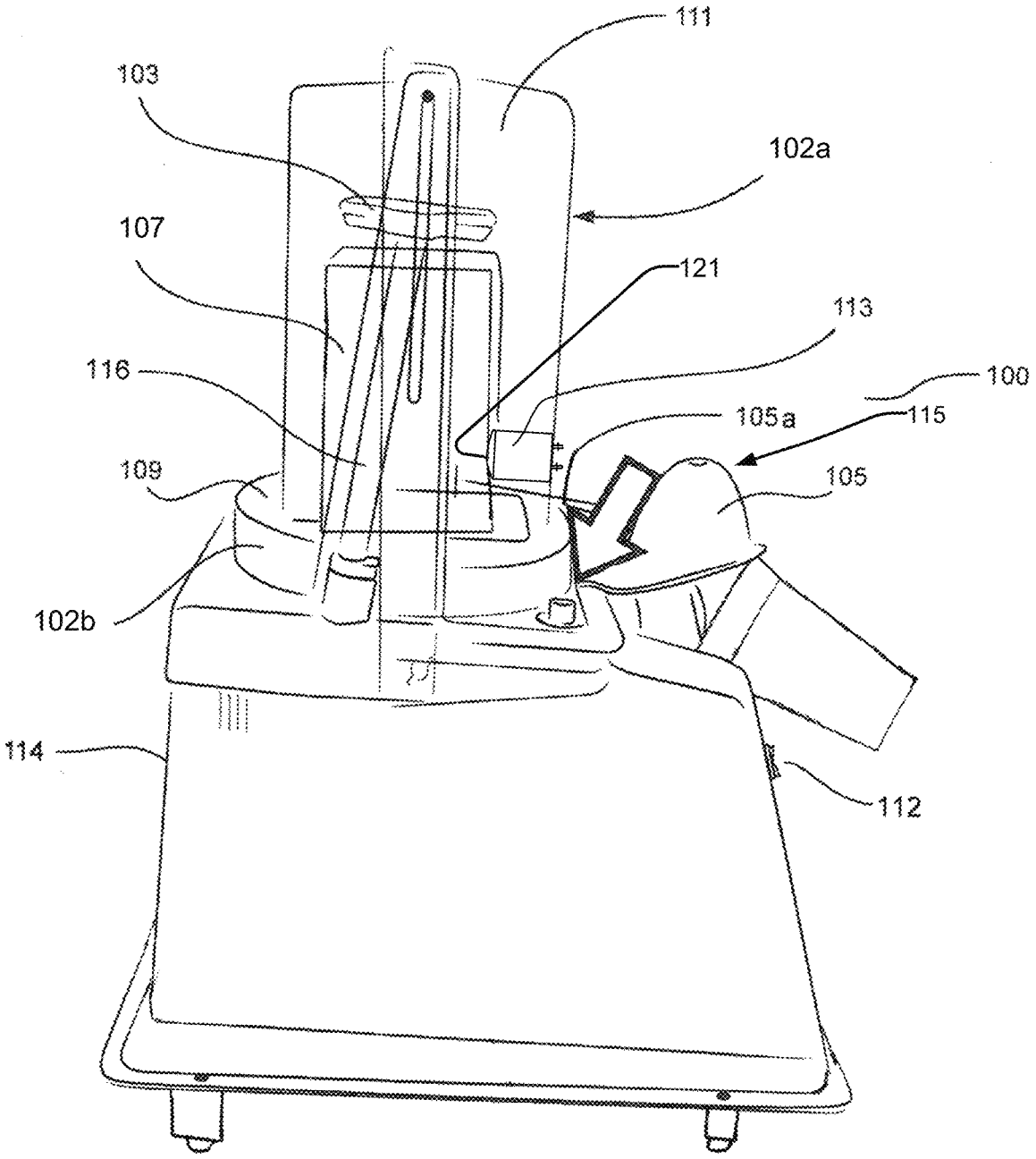
FIG. 19 illustrates a side view of an embodiment of a housing with an ice block guide or a tension arm made in accordance with the teachings and principles of the disclosure.
Figure 20:
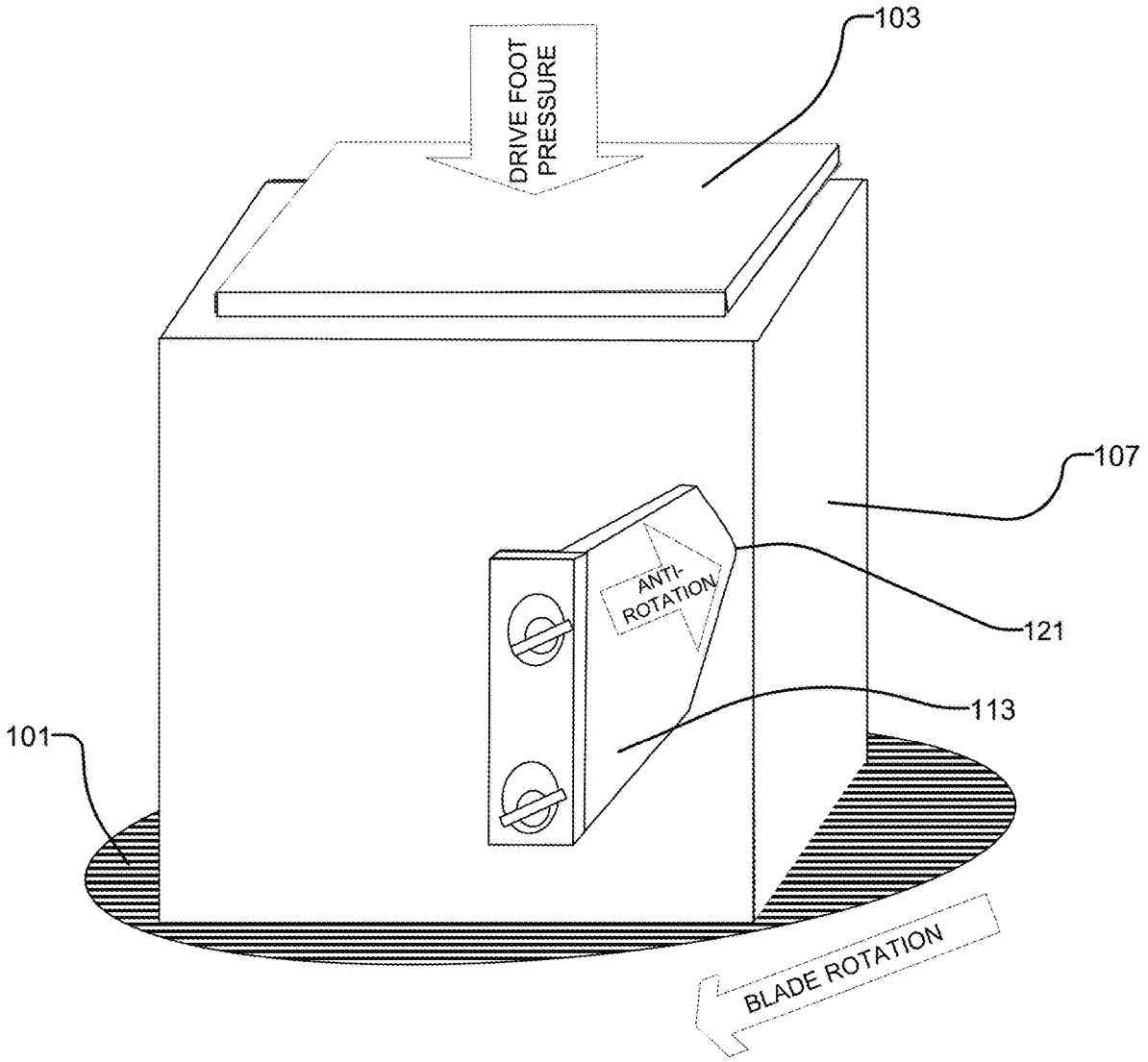
FIG. 20 illustrates a schematic view of an embodiment of a housing with an ice block guide or a tension arm that resists rotational forces of a block of ice that is being shaved by a rotating blade and made in accordance with the teachings and principles of the disclosure.

FIGS. 18-21 illustrate various views of an ice shaving machine having a housing partially lifted up with an ice block guide or a tension arm 113 thereon in accordance with the teachings and principles of the disclosure. The ice block guide or tension arm 113 illustrated may provide a force on a block of ice to be shaved by the blade 101 of the ice shaving machine 100. FIGS. 18-20 illustrate the ice block guide or tension arm 113 with the other features and structures disclosed herein. It will be appreciated that the ice block guide or tension arm 113 may resist rotational forces of a block of ice 107 that is being shaved by the rotating blade 101.

It will be appreciated that the tension arm 113 may be sized and shaped in various manners. For example, the ice block guide or tension arm 113 may comprise an edge 121, wherein the edge 121 is configured to contact the block of ice 107, thereby placing a compressive force on the block of ice 107. It will be appreciated that the edge 121 may be oriented parallel to the block of ice during shaving, such that the block of ice 107 travels along the edge 121 while being shaved.

The ice block guide or tension arm 113 may be removably attached to the safety cover 102*a* with fasteners or the like. It will be appreciated that the fasteners may be removable without the use of tools to thereby facilitate easy maintenance and installation of the guide or arm 113. The ice block guide or tension arm 113 may be substantially rigid and manufactured or made of unitary construction and material. The ice block guide or tension arm 113 may be made from a polymer or other suitable material that can provide a force on the ice block without departing from the spirit or scope of the disclosure. The ice block guide or tension arm 113 may comprise a blade portion that comprises the edge 121 that is shaped to optimally contact the block of ice. The blade portion may further comprise a rounded profile or the blade portion may comprise a sharpened edge.

Figure 21:
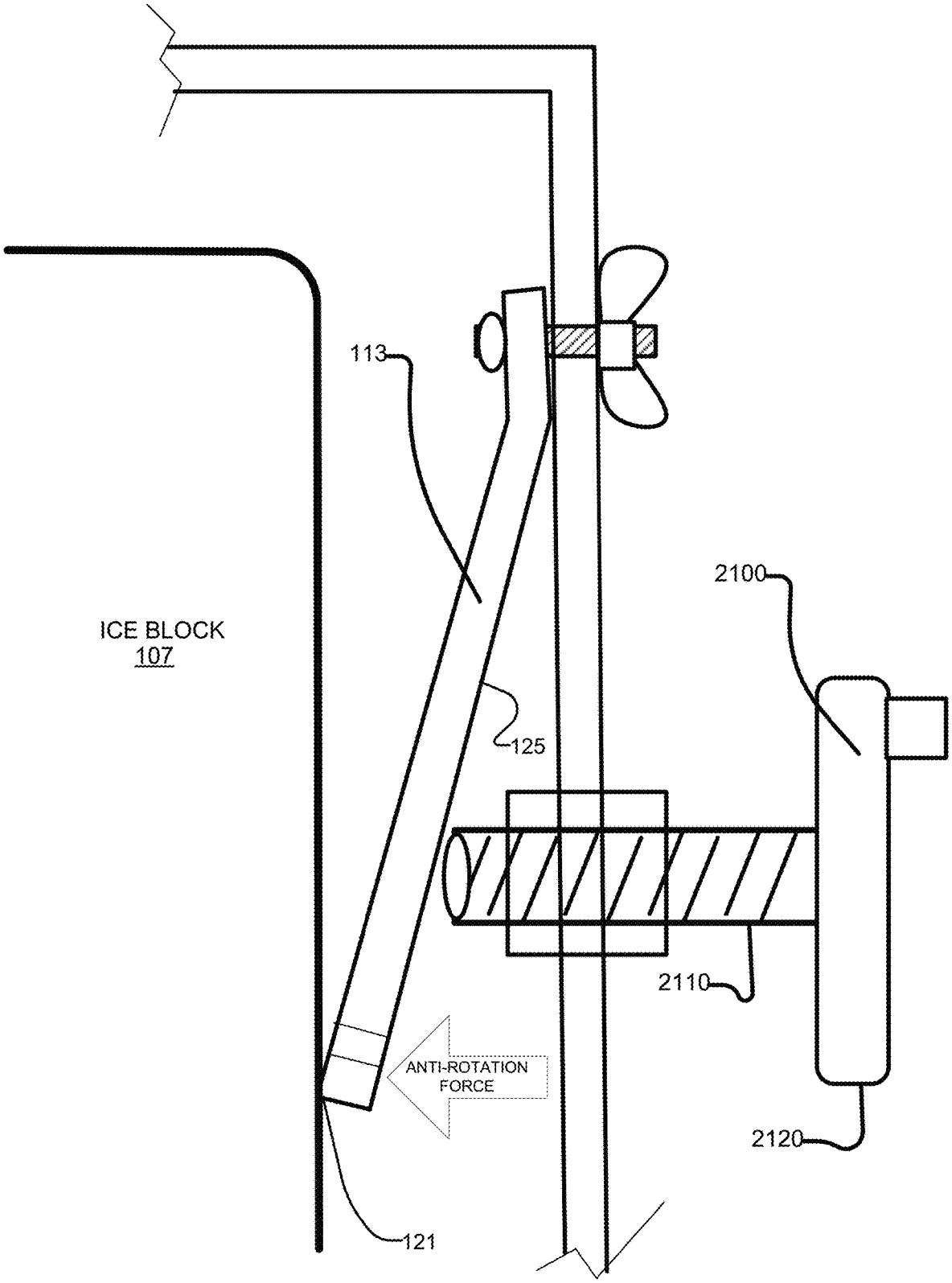
FIG. 21 illustrates a schematic view of an embodiment of a housing of an ice shaving machine with an ice block guide or a tension arm made in accordance with the teachings and principles of the disclosure.
Figure 23:
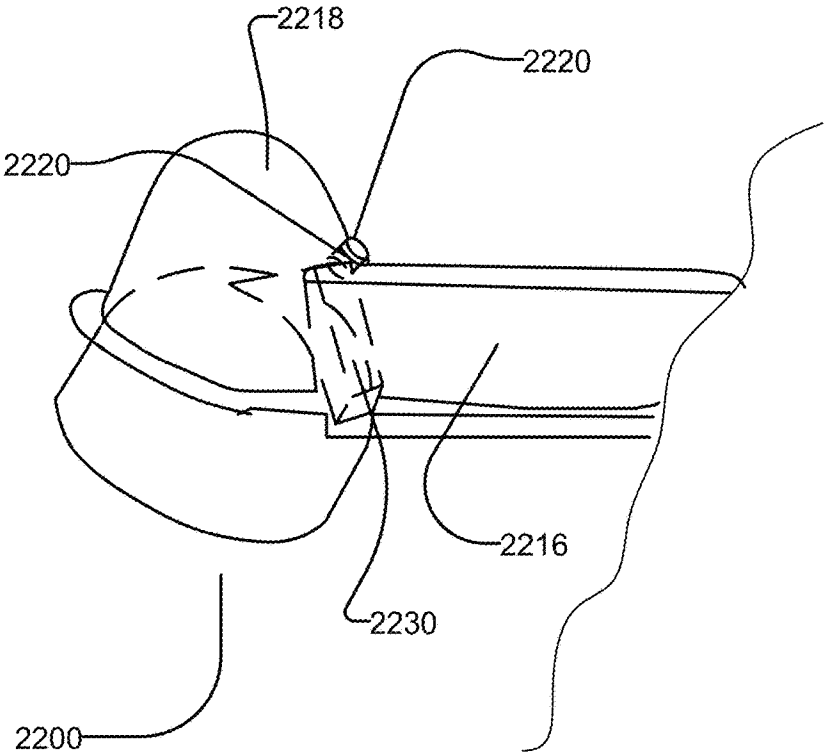
FIG. 23 illustrates an embodiment of a shaping device attached to a spout assembly of an ice shaving machine in accordance with the teachings and principles of the disclosure.
Figure 22:
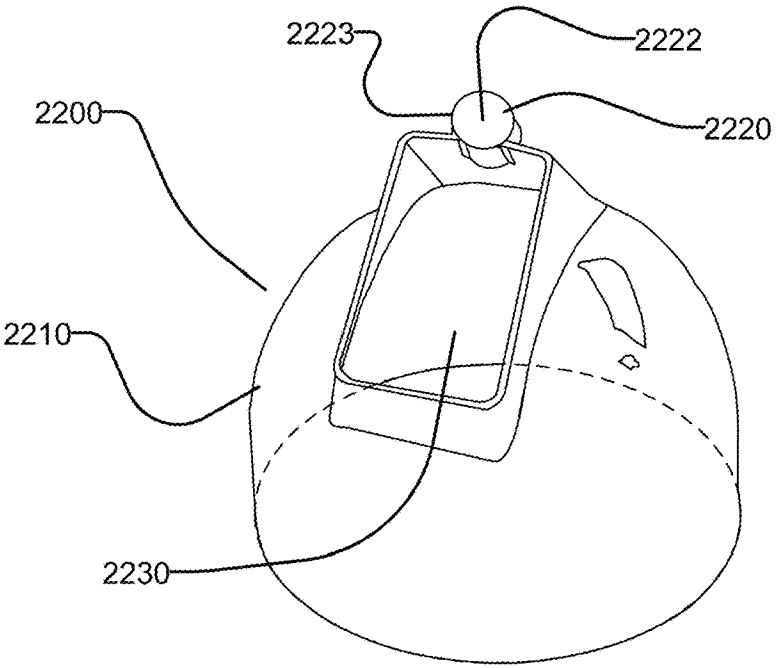
FIG. 22 illustrates an embodiment of a shaping device made in accordance with the teachings and principles of the disclosure.
Figure 24:
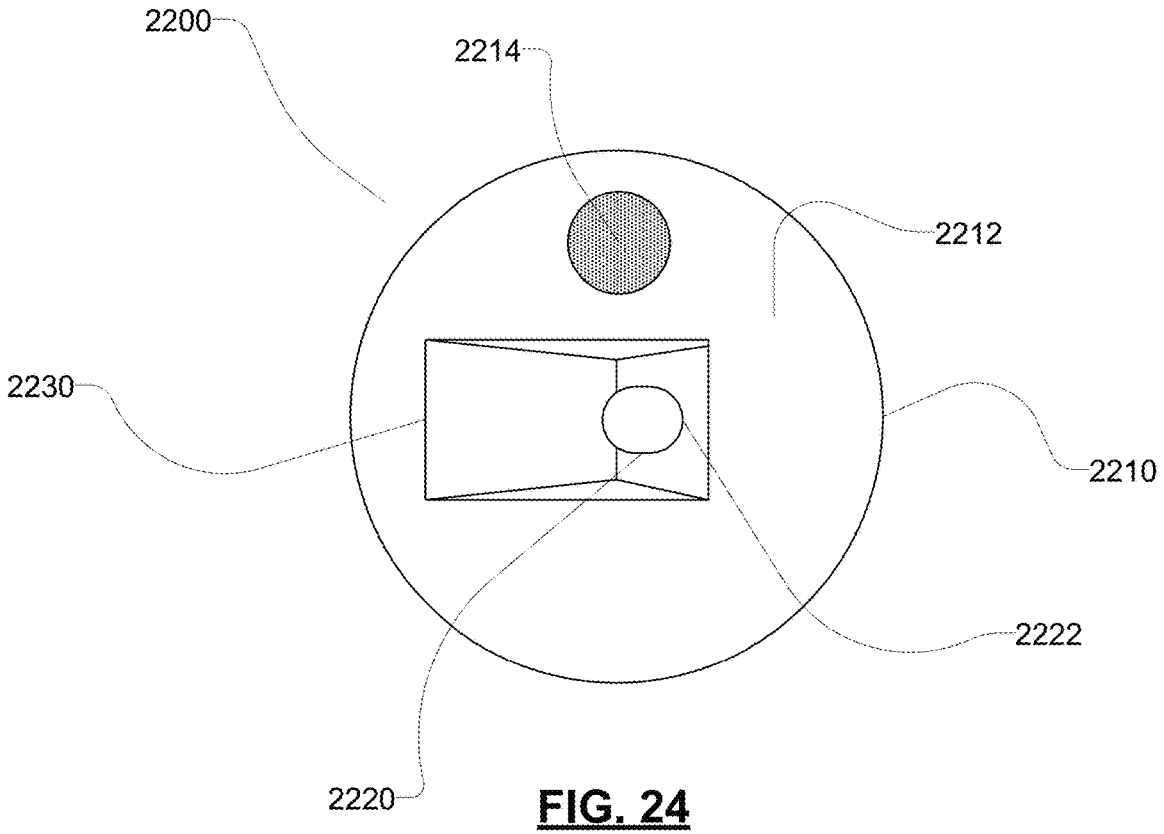
FIG. 24 illustrates a bottom view of an implementation of a shaping device for producing a shaved ice or snow cone product in accordance with the teachings and principles of the disclosure.
Figure 25:
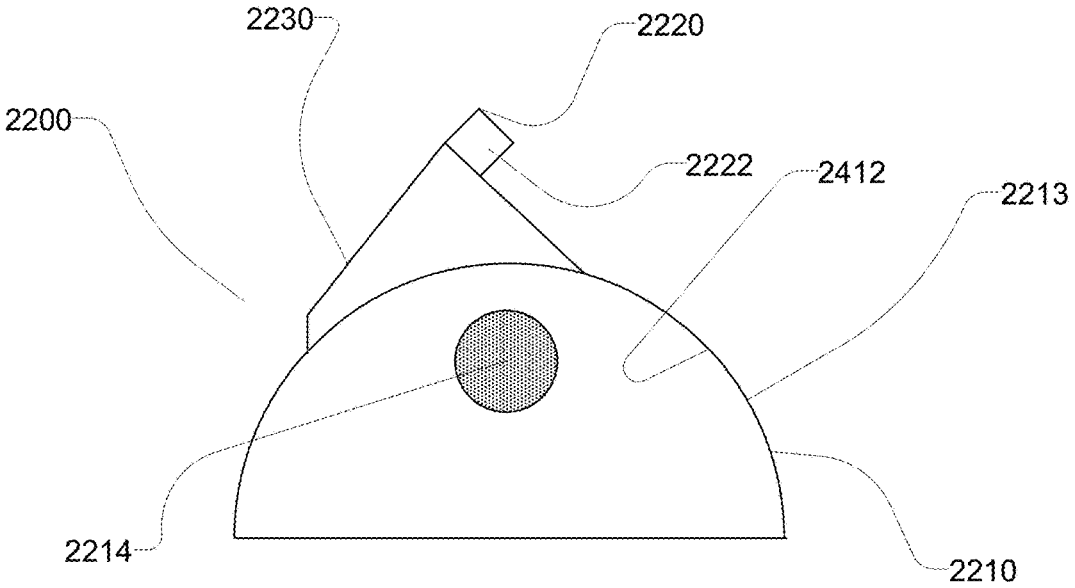
FIG. 25 illustrates a side view of an implementation of a shaping device for producing a shaved ice or snow cone product in accordance with the teachings and principles of the disclosure.

Referring now specifically to FIG. 21, the ice shaving machine may further comprise a tensioning mechanism 2100 for adjusting a force that the tensioning arm 113 exerts on the ice block 107, wherein the tensioning mechanism 2100 contacts a surface 125 of the tensioning arm 113. The tensioning mechanism 2100 may comprise a threaded member 2110 and a crank 2120 having a handle, which is configured to drive the threaded member 2110. It will be appreciated that the crank 2120 may be hand operated, or the crank 2120 may be driven by an electric motor without departing from the scope of the disclosure. Further, it will be appreciated that the tensioning mechanism 2100 may automatically adjust relative to a size of the block of ice 107, such that as the block of ice melts faster the tensioning mechanism automatically adjusts by placing added force on the block of ice to thereby maintain the block of ice in position for efficient shaving.

Referring now to FIGS. 22-27, there is illustrated an embodiment of a shaping device 2200 and a system for shaping shaved ice products made in accordance with the teachings and principles of the disclosure.

It will be appreciated that a variety of machines have been developed, described and are widely known for creating or processing cold deserts and confectioneries by processing ice into more appealing eatable forms, such as snow cones and shaved ice and the like. Such devices produce either ice granules (snow cones) or light, fluffy, finely textured shaved ice for subsequent flavoring using syrups.

Machines in the marketplace may have a spout assembly comprising a channel that leads to a spout for expelling shaved ice or snow cone from the machine to a cup or other container for consumption by a user. Such spout assemblies, or spouts that expel shaved ice or snow, are often made from a hard plastic or other rigid material, such that adaptation to different shapes and sizes of cups is often difficult. For example, different cup styles and types, each having their own benefit to a consumer, are becoming increasingly popular. One such shape is a flower cup, but other open faced cups having large mouths or openings for creating a larger container for efficiently contain a shaved ice product are also becoming popular. To effectively fill these different cup sizes and styles with shaved ice, a different size spout may often be required to increase the efficiency (e.g., speed) of filling a cup with shaved ice or ice granules (snow cones).

In addition, because shaved ice or snow cone machines have an associated cost for each unit it is often expensive to provide multiple machines at one location. Even if multiple machines are financially feasible, changing from one machine to another tends to cause slowness to the overall shaved ice or snow cone operation, which may be disadvantageous in industries (such as shaved ice) where speed is required to keep a consumer line moving. For example, moving between machines or changing out machines may require large amounts of human capital to operate, thereby reducing the efficiency of a business.

In some instances an operator may use a sanitary glove to shape a shaved ice or snow cone product. The operator may be required to remove or change the sanitary glove after handling money or otherwise exposing the glove to an unsanitary surface. That glove change or removal process may slow down the efficiency of the business.

In various industries, for example a shaved ice or snow cone business or any other business in the concessions industry, it is important for the success of that business to move customers through a waiting line as quickly as possible to finalize the sale of a confectionary product to customers. In the example of a shaved ice or snow cone business, the ability to quickly modify the spout to fill different sizes and types of cups on the fly at the job site is imperative to the success of a shaved ice or snow cone concession stand, especially in locations where time is of the essence, for example at a halftime break at a sporting event or other intermission. Otherwise, when moving between machines or modifying the spout of the machine consumes too much time the business will lose out on the opportunity to make a sale. This is because the break or intermission is either over or the customers are tired of waiting in long lines and will seek other concessions.

FIGS. 22-27 illustrate an apparatus, system and method for attaching a device or an assembly to a spout or other part of the shaved ice or snow cone machine in an efficient, effective and elegant manner that will allow a user to fill various size and shapes of cups or containers.

The shaping device and system for producing a shaved ice or snow cone product are illustrated and may comprise an ice shaving or snow cone machine, including all of its component parts, a shaping device 2200, and a blade for producing a shaved ice or snow cone product.

The shaping device 2200 may be used in conjunction with an ice shaving or snow cone machine 100 (illustrated best in FIGS. 1-2B, and 18) for producing a shaved ice or snow cone product. Due to the various shapes and sizes of containers, particularly those with open mouths or large-mouth openings, that may be used to contain a shaved ice or snow cone product, there are times when providing a shaping device 2200 may be advantageous for efficiently filling such containers not only due to ease of use, but also in time savings for filling such containers. Further, the use of the shaping device 2200 in conjunction with various machines for producing a shaved ice or snow cone product may also eliminate the need for a user to utilize his or her hands (whether gloved or otherwise) to shape the shaved ice or snow cone product, thereby making the product more sanitary. The shaping device 2200 may comprise a body 2210 that may be sized and shaped to produce the shaved ice or snow cone product. It will be appreciated that the shaved ice or snow cone product may correspond in shape with the shape of the body 2210 of the shaping device 2200.

The body 2210 of the shaping device 2200 may comprise an inner surface 2212 and an outer surface 2213. The inner surface 2212 of the body 2210 may comprise a textured surface 2214. The textured surface 2214 may be used to produce a shaved ice or snow cone product having a corresponding textured shape.

The shaping device 2200 may also comprise a mechanism 2220 for attaching the shaping device 2200 to the ice shaving or snow cone machine 100. The mechanism 2220 may comprise a connector 2222 that may be configured and dimensioned for communicating with a portion of the ice shaving or snow cone machine 100. The shaping device 2200 may also comprise a chute 2230 that may be configured and dimensioned for mechanically communicating with a spout 105 or spout assembly 115 of the ice shaving or snow cone machine 100. The chute 2230 may be in mechanical communication with the body 2210, such that as ice is shaved via a blade 2201 of the ice shaving or snow cone machine 100, the shaved ice or snow cone moves through the spout assembly 115 of the ice shaving or snow cone machine 100 into the chute 2230 and into a user's cup or container for carrying or consumption. The chute 2230 may comprise a wall or a plurality of walls that may be sized and shaped to matingly engage and mechanically communicate with a corresponding channel or passageway of the spout 105 or the spout assembly 115, such that when shaved ice or snow cone is expelled it may be expelled from the spout 105 or spout assembly 115 through the chute 2230 and into the container or cup. It will be appreciate that the body 2210 of the shaping device 2200 may ultimately be used to form the shape of the shaved ice or snow cone product as noted above.

Referring now to the various mechanisms 2220 for attaching the shaping device 2200 to the ice shaving or snow cone machine 100, it will be appreciated that in one implementation, the connector 2222 of the shaping device 2200 may be a magnet. In an implementation, the magnet (connector 2222) may be in magnetic communication with any metallic portion of the ice shaving or snow cone machine 100. In such an implementation, the connector 2222 does not necessarily have to be in mechanical communication with the spout 105 or spout assembly 115. Instead, a cup or container may be placed beneath the spout 105 or spout assembly 115 and subsequently matched with the shaping device 2200. However, it will be understood that it may be advantageous to locate the shaping device 2200 in close proximity to the spout 105 or spout assembly 115.

Figure 26:
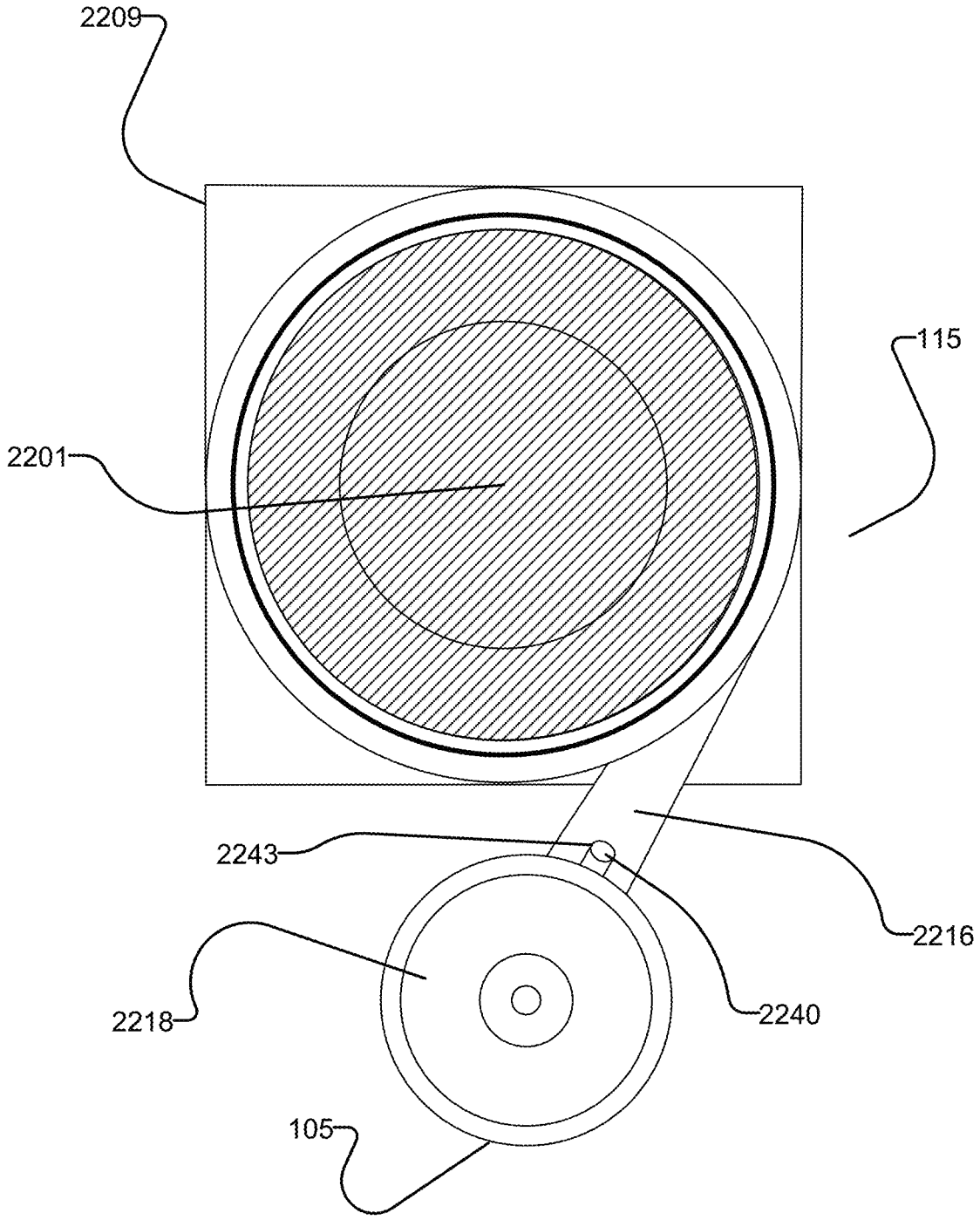
FIG. 26 illustrates a top view of an implementation of a system comprising a shaping device for producing a shaved ice or snow cone product in accordance with the teachings and principles of the disclosure.
Figure 27:
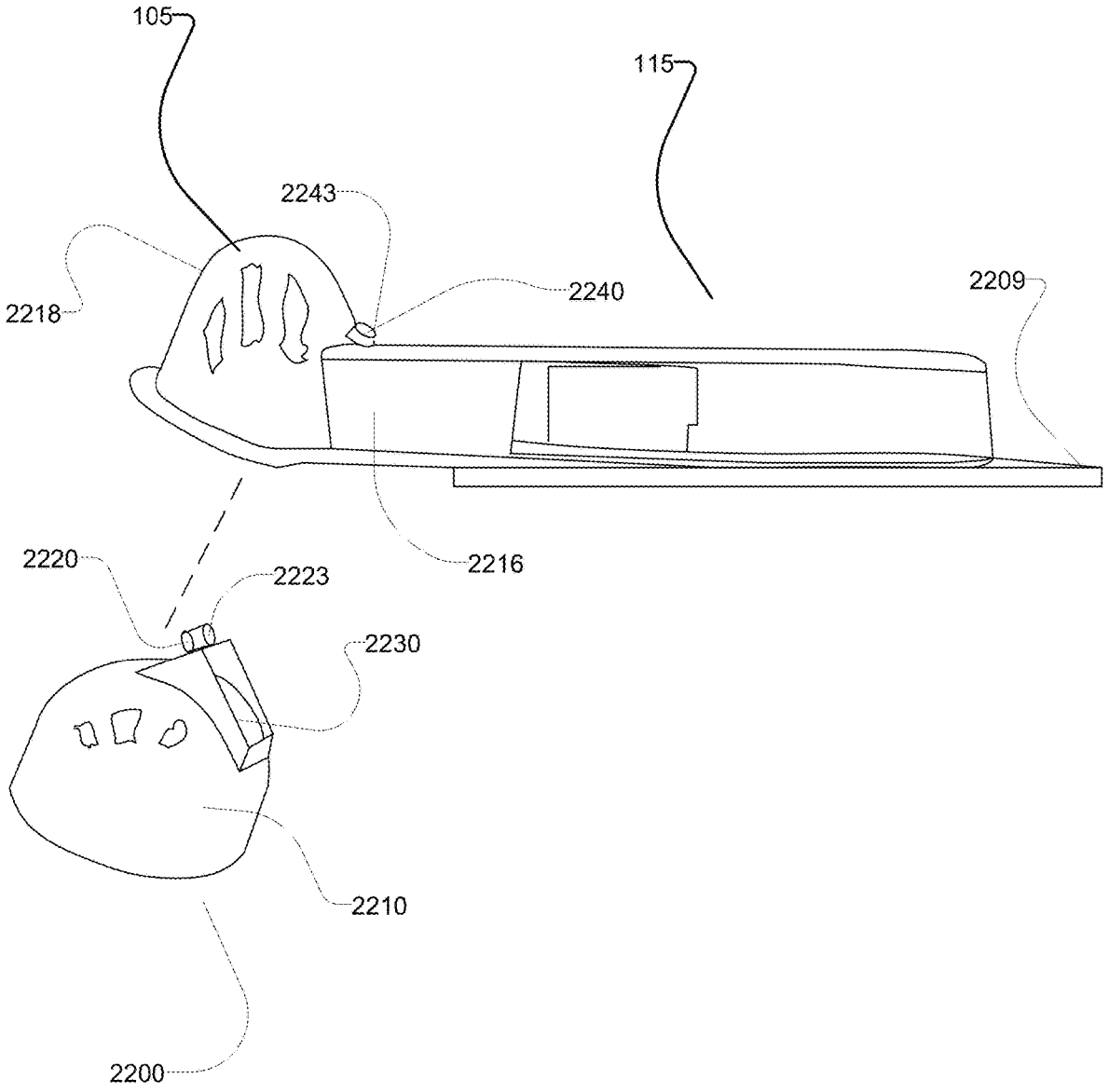
FIG. 27 illustrates a side view of an implementation of a system comprising a shaping device for producing a shaved ice or snow cone product in accordance with the teachings and principles of the disclosure.

Referring specifically to FIGS. 26-27, the ice shaving or snow cone machine 100 may comprise an area wherein ice may enter into to be introduced to the blade 2201. Once the ice is shaved by the blade 2201, the ice may travel through a channel 2216 before being expelled from the spout 105. The spout assembly 115 may comprise a corresponding connector mechanism 2240. In one implementation, the connector 2222 of the shaping device 2200 may be a first magnet 2223 that may be in magnetic communication with the corresponding connector mechanism 2240 of the spout assembly 115. In such an implementation, the connector mechanism 2240 may be a second magnet 2243 that may be connected to the ice shaving or snow cone machine 100. In an implementation, the first magnet 2223 may be attached to a portion of the chute 2230 and the second magnet 2243 may be attached to the spout 105 of the ice shaving or snow cone machine 100, such that the first magnet 2223 and the second magnet 2243 together hold the shaping device 2200 in location with respect to the spout 105 and spout assembly 115.

It will be appreciated that in an implementation the connector 2222 of the shaping device 2200 may be mechanically attachable to a portion of the ice shaving or snow cone machine 100. For example, the mechanical attachment of the connector 2222 may include a lip that attaches to a corresponding flange, a bolted assembly, a hook and loop fastener, a screw, a latch, a threaded metal insert, and a press fit connection that attaches the shaping device 2200 to a portion of the ice shaving or snow cone machine 100. In an implementation, the connector 2222 may be chosen from a group the group consisting of a lip that attaches to a corresponding flange, a bolted assembly, a hook and loop fastener, a screw, a latch, a threaded metal insert, and a press fit connection that attaches the shaping device 2200 to a portion of the ice shaving or snow cone machine 100.

It will be appreciated that the shaping device 2200 and the spout assembly 115 may be manufactured from a polymeric material, including the spout 105. The spout 105 may comprise a dome 2218 that helps shape the product, when the shaping device 2200 is disconnected from the spout assembly 115.

In an implementation, the shaping device 2200 may comprise an attachment mechanism having a connector 2222, wherein the connector 2222 may be a lip that attaches to a corresponding flange on the spout 105 of the spout assembly 115.

It will be appreciated that the body 2210 of the shaping device 2200 may be any shape, including but not limited to circular shapes, oval shapes, triangular shapes, rectangular shapes, square shapes, pentagonal shapes, hexagonal shapes, octagonal shapes and other shapes that may be used to shape a shaved ice or snow cone product. Other shapes that the body may include are star, crescent, and flower shapes. In one implementation, the body 2210 may be domed shaped, such that the resulting shaved ice or snow cone product is correspondingly domed shaped. It will be appreciated that various shapes and sizes of shaping devices and bodies may be used without departing from the spirit or scope of the disclosure.

The foregoing description has been presented for the purposes of illustration and description. It is not intended to be exhaustive or to limit the disclosure to the precise form disclosed. Many modifications and variations are possible in light of the above teaching. Further, it should be noted that any or all of the aforementioned alternate implementations may be used in any combination desired to form additional hybrid implementations of the disclosure.

Further, although specific implementations of the disclosure have been described and illustrated, the disclosure is not to be limited to the specific forms or arrangements of parts so described and illustrated. The scope of the disclosure is to be defined by the claims that may be appended hereto, any future claims submitted here and in different applications, and their equivalents.

What is claimed is:

1. An ice shaving machine, comprising:

a cabinet;

a mechanical drive mechanism;

a control mechanism for activating and deactivating said mechanical drive mechanism; and a blade assembly mechanically connected to said mechanical drive mechanism, said blade assembly comprising:

a blade configured to rotate relative to a block of ice when said mechanical drive mechanism is activated and comprising a plurality of attachment points; and a blade holder configured to detachably retain said blade at the plurality of attachment points, wherein said blade holder has a plurality of arms that extend outwardly from a center hub and each of the plurality of arms comprises a blade attachment portion that corresponds with respective ones of the plurality of attachment points of said blade;

wherein the center hub comprises a blade support that mechanically communicates and interacts with said blade to control an amount of flex of said blade as a load is placed on said blade.

2. The ice shaving machine of claim 1, wherein the center hub has a height relative to a base of the blade holder that is different than heights of the blade attachment portions relative to the base of the blade holder.

3. The ice shaving machine of claim 2, wherein the height of the center hub is greater than the heights of the blade attachment portions.

4. The ice shaving machine of claim 2, wherein the height of the center hub is less than the heights of the blade attachment portions.

5. The ice shaving machine of claim 1, wherein the center hub has a height relative to a base of the blade holder that is the same as heights of the blade attachment portions relative to the base of the blade holder.

6. The ice shaving machine of claim 1, wherein said plurality of arms each further comprise a pass through portion.

7. The ice shaving machine of claim 1, wherein said center hub is configured to mechanically couple with the mechanical drive mechanism.

8. The ice shaving machine of claim 1, wherein the blade is attached to the blade holder and is placed under tension.

9. The ice shaving machine of claim 1, wherein each of the blade attachment portions correspond with the respective ones of the plurality of attachment points of the blade, wherein a radial measurement from a center of rotation of the blade holder to said blade attachment portions of each of said arms is less than a radial measurement from a center of rotation of the blade to said plurality of attachment points of said blade, thereby causing said blade to be placed in tension when said blade is assembled to said blade holder.

10. The ice shaving machine of claim 1, wherein each of the plurality of arms of said blade holder are curved.

11. The ice shaving machine of claim 1, wherein said plurality of attachment points of said blade outnumber the plurality of arms of said blade holder.

12. The ice shaving machine of claim 1, wherein said blade is releasably attached to said blade holder, such that said blade is positionable relative to said blade holder by detaching and rotating said blade with respect to said blade holder and then reattaching said blade to said blade holder.

13. A blade assembly for use in shaving a block of ice comprising:

a blade configured to rotate relative to the block of ice;

wherein said blade comprises:

a plurality of attachment points, wherein at least one of said attachment points is disposed around a perimeter of said blade; and a blade holder configured to detachably retain said blade at the plurality of attachment points;

wherein said blade holder comprises a plurality of arms that extend outwardly from a center hub, wherein each of said plurality of arms comprises a blade attachment portion that corresponds with respective ones of the plurality of attachment points of said blade;

wherein the center hub comprises a blade support that mechanically communicates and interacts with said blade to control an amount of flex of said blade as a load is placed on said blade.

14. The ice shaving machine of claim 13, wherein the center hub has a height relative to a base of the blade holder that is different than heights of the blade attachment portions relative to the base of the blade holder.

15. The ice shaving machine of claim 14, wherein the height of the center hub is greater than the heights of the blade attachment portions.

16. The ice shaving machine of claim 14, wherein the height of the center hub is less than the heights of the blade attachment portions.

17. The ice shaving machine of claim 13, wherein the center hub has a height relative to a base of the blade holder that is the same as heights of the blade attachment portions relative to the base of the blade holder.

18. The blade assembly of claim 13, wherein a radial measurement from a center of rotation of the blade holder to said blade attachment portion of each of said arms is less than a radial measurement from a center of rotation of the blade to said plurality of attachment points of said blade, thereby causing said blade to be placed in tension when said blade is assembled to said blade holder.

19. The blade assembly of claim 13, wherein said plurality of attachment points of said blade outnumber the plurality of arms of said blade holder.

20. The blade assembly of claim 13, wherein said blade is releasably attached to said blade holder, such that said blade is positionable relative to said blade holder by detaching and rotating said blade with respect to said blade holder and then reattaching said blade to said blade holder.

* * * * *